US007051725B2

(12) United States Patent
Ikemoto et al.

(10) Patent No.: US 7,051,725 B2
(45) Date of Patent: May 30, 2006

(54) CYLINDER-BY-CYLINDER AIR-FUEL RATIO CALCULATION APPARATUS FOR MULTI-CYLINDER INTERNAL COMBUSTION ENGINE

(75) Inventors: Noriaki Ikemoto, Obu (JP); Hisashi Iida, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/901,087

(22) Filed: Jul. 29, 2004

(65) Prior Publication Data

US 2005/0022797 A1 Feb. 3, 2005

(30) Foreign Application Priority Data

Jul. 30, 2003 (JP) ..... 2003-283143
Dec. 24, 2003 (JP) ..... 2003-427064
May 7, 2004 (JP) ..... 2004-138027

(51) Int. Cl.
*F02D 41/14* (2006.01)

(52) U.S. Cl. ..... 123/673; 701/109

(58) Field of Classification Search ..... 123/673; 701/109

See application file for complete search history.

(56) References Cited

U.S. PATENT DOCUMENTS 4,445,326 A 5/1984 Lyon
5,524,598 A 6/1996 Hasegawa et al.
5,542,404 A 8/1996 Hasegawa et al.
5,700,954 A 12/1997 Sinha et al.
5,730,111 A 3/1998 Kaji et al.
5,806,012 A * 9/1998 Maki et al. ..... 701/104
5,908,463 A * 6/1999 Akazaki et al. ..... 701/104
2005/0120786 A1 6/2005 Tsujimura et al.

FOREIGN PATENT DOCUMENTS

JP B2-3-37020 6/1984
JP 6-45644 11/1994
JP 7-34946 2/1995
JP 7-224709 8/1995
JP 7-317586 12/1995
JP A-8-338285 12/1996

OTHER PUBLICATIONS

Office Action dated Sep. 30, 2005 in U.S. Appl. No. 11/001,647.

* cited by examiner

*Primary Examiner*—Erick Solis
(74) *Attorney, Agent, or Firm*—Nixon & Vanderhye P.C.

(57) ABSTRACT

An air-fuel ratio deviation calculated by an air-fuel ratio deviation calculation part is inputted to a cylinder-by-cylinder air-fuel ratio estimation part. A cylinder-by-cylinder air-fuel ratio is estimated in the cylinder-by-cylinder air-fuel ratio estimation part. In the cylinder-by-cylinder air-fuel ratio estimation part, attention is paid to gas exchange in an exhaust collective part of an exhaust manifold, and a model is created. In this model, a detection value of an A/F sensor is obtained by multiplying histories of the cylinder-by-cylinder air-fuel ratio of an inflow gas in the exhaust collective part and histories of the detection value of the A/F sensor by specified weights respectively and by adding them. The cylinder-by-cylinder air-fuel ratio is estimated on the basis of the model.

29 Claims, 17 Drawing Sheets

CYLINDER-BY-CYLINDER AIR-FUEL RATIO CALCULATION APPARATUS FOR MULTI-CYLINDER INTERNAL COMBUSTION ENGINE

CROSS-REFERENCE TO RELATED APPLICATION

This application is based on Japanese Patent Application No. 2003-283143 filed on Jul. 30, 2003, Japanese Patent Application No. 2003-427064 filed on Dec. 24, 2003 and Japanese Patent Application No. 2004-138027 filed on May 7, 2004, the disclosures of which are incorporated herein by reference.

FIELD OF THE INVENTION

The present invention relates to a cylinder-by-cylinder air-fuel ratio calculation apparatus for a multi-cylinder internal combustion engine, and particularly to a technique in which an air-fuel ratio sensor installed in an exhaust collective part of a multi-cylinder internal combustion engine is used, and an air-fuel ratio for each cylinder is suitably calculated on the basis of a detection value of the sensor.

BACKGROUND OF THE INVENTION

Conventionally, there is proposed an air-fuel ratio control apparatus in which an exhaust air-fuel ratio of an internal combustion engine is detected, and a fuel injection a mount is controlled to achieve a target air-fuel ratio. However, in the case of a multi-cylinder internal combustion engine, variations in intake air amounts between cylinders occurs due to the shape of an intake manifold, the operation of intake valves and the like. In the case of an MPI (Multi Point Injection) system in which a fuel injection valve is provided for each cylinder, and fuel injection is individually performed, variations in fuel amounts between the cylinders occur due to the individual difference among fuel injection devices, or the like. Since the accuracy of the fuel injection amount control is deteriorated due to the variations between the cylinders, for example, in JP-8-338285A, at the time of air-fuel ratio detection by an air-fuel ratio sensor, it is specified which cylinder an exhaust as an actual detection object came from, and in each case, an air-fuel ratio feedback control is performed individually for the specified cylinder.

In JP-3-37020B, an air-fuel ratio of an exhaust collective part is detected using an air-fuel ratio sensor, and in view of a delay until the exhaust of the pertinent cylinder reaches the air-fuel ratio sensor, the fuel supply amount of the pertinent cylinder is corrected.

However, in the techniques of the above patents, when consideration is given to the fact that the exhausts of the respective cylinders are mixed in the exhaust collective part, the variations between the cylinders cannot be sufficiently resolved, and a further improvement is desired. Especially, JP-3-37020B is effective only in the case where the exhaust is regarded as being laminar in a passage direction. Incidentally, in order to obtain the air-fuel ratio for each cylinder with high accuracy, an air-fuel ratio sensor has only to be disposed at each branch pipe of an exhaust manifold. However, this requires the air-fuel ratio sensors the number of which is equal to the number of cylinders, and the cost is increased.

In Japanese Patent No. 2717744, a model is created in which an air-fuel ratio in an exhaust collective part is made a weighted average obtained by multiplying combustion histories by specified weights, internal state amounts are made the combustion histories, and an air-fuel ratio of each cylinder is detected by an observer. However, in this model, the air-fuel ratio in the exhaust collective part is determined by the finite combustion histories (combustion air-fuel ratios), and the histories must be increased in order to improve the accuracy, and there has been a fear that the amount of calculation is increased and the modeling becomes complicated.

SUMMARY OF THE INVENTION

The invention has a primary object to provide a cylinder-by-cylinder air-fuel ratio calculation apparatus for a multi-cylinder internal combustion engine in which the complication of modeling is resolved by using a simple model, and a cylinder-by-cylinder air-fuel ratio can be calculated with high accuracy, and to realize an improvement in accuracy of an air-fuel ratio control performed using this cylinder-by-cylinder air-fuel ratio.

In the invention, a model is created in which a sensor detection value of an air-fuel ratio sensor is obtained by multiplying a history of a cylinder-by-cylinder air-fuel ratio of an inflow gas in an exhaust collective part and a history of the sensor detection value by specified weights respectively and by adding them, and the cylinder-by-cylinder air-fuel ratio is estimated on the basis of the model. According to the structure as stated above, since the model is used in which attention is paid to the inflow of the gas and the mixture in the exhaust collective part, the cylinder-by-cylinder air-fuel ratio can be calculated which reflects gas exchange behavior in the exhaust collective part. Besides, since the model (autoregressive model) is used in which the sensor detection value is predicted from the past value, differently from the conventional structure using the finite combustion histories (combustion air-fuel ratios), it is not necessary to increase the histories to improve the accuracy. As a result, the complication of modeling is resolved by using the simple model, and the cylinder-by-cylinder air-fuel ratio can be calculated with high accuracy.

DETAILED DESCRIPTION OF EMBODIMENTS (First Embodiment)

Hereinafter, a first embodiment embodying the invention will be described with reference to the drawings. In this embodiment, an engine control system is constructed for a vehicle-mounted 4-cylinder gasoline engine as a multi-cylinder internal combustion engine. In the control system, an engine controlling electronic control unit (hereinafter referred to as an engine ECU) is made the center, and the control of a fuel injection amount, the control of an ignition timing and the like are carried out. First, the main structure of this control system will be described with reference to FIG. 1.

Figure 1:
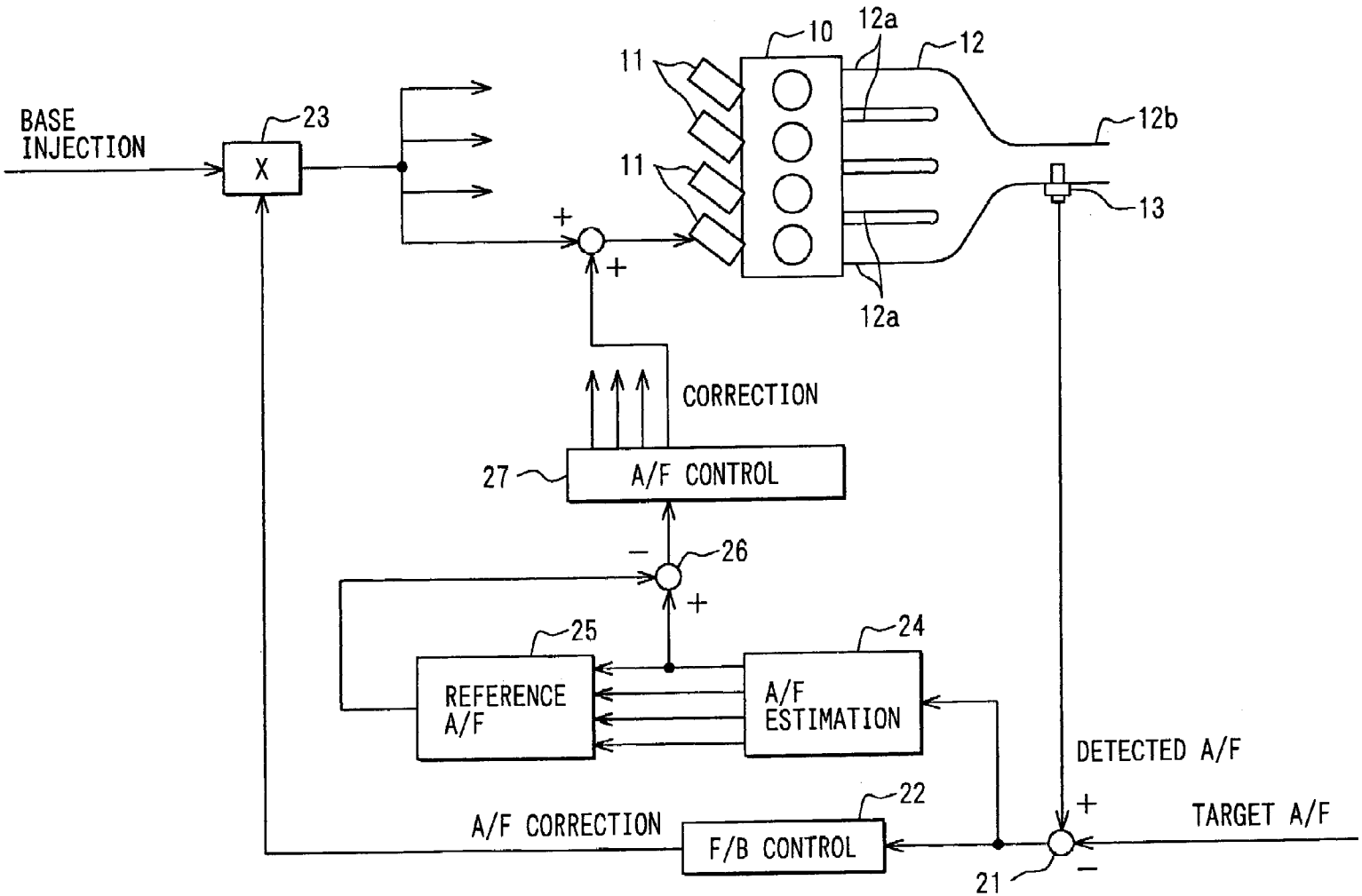
FIG. 1 is a schematic block diagram of an engine control system according to a first embodiment of the resent invention.

In FIG. 1, electromagnetic driven fuel injection valves 11 are attached to respective cylinders in the vicinities of intake ports of an engine 10. When fuel is injected and supplied to the engine 10 from the fuel injection valves 11, in the intake port of each of the cylinders, intake air and the injected fuel by the fuel injection valve 11 are mixed to form a mixed gas, and this mixed gas is introduced into a combustion chamber of each of the cylinders when an intake valve (not shown) is opened, and is burned.

The mixed gas burned in the engine 10 is discharged as an exhaust through an exhaust manifold 12 when an exhaust valve (not shown) is opened. The exhaust manifold 12 includes branch parts 12*a* branching from the respective cylinders and an exhaust collective part 12*b* in which the branch parts 12*a* are collected. An A/F sensor 13 for detecting the air-fuel ratio of the mixed gas is provided in the exhaust collective part 12*b*. The A/F sensor 13 corresponds to an air-fuel ratio sensor, and linearly detects the air-fuel ratio in a wide range.

Although not shown, in this control system, in addition to the A/F sensor 13, there are provided various sensors such as an intake pipe negative pressure sensor for detecting intake pipe negative pressure, a water temperature sensor for detecting engine water temperature, and a crank angle sensor for outputting a crank angle signal at every specified crank angle. Similarly to the detection signal of the A/F sensor 13, the detection signals of the various sensors are also suitably inputted to the engine ECU.

In the engine 10 with the above structure, the air-fuel ratio is calculated on the basis of the detection signal of the A/F sensor 13, and the fuel injection amount for each cylinder is F/B (feedback) controlled so that the calculated value coincides with a target value. The basic structure of the air-fuel ratio F/B control will be described with reference to FIG. 1. A deviation between the detected air-fuel ratio calculated from the detected signal of the A/F sensor 13 and the separately set target air-fuel ratio is calculated in an air-fuel ratio deviation calculation part 21, and an air-fuel ratio correction coefficient is calculated in an air-fuel ratio F/B control part 22 on the basis of the deviation. In an injection amount calculation part 23, a final injection amount is calculated from a base injection amount calculated on the basis of an engine speed, engine load (for example, intake pipe negative pressure) and the like, the air-fuel ratio correction coefficient and the like. The fuel injection valve 11 is controlled based on the final injection amount. The flow of this control is similar to the conventional air-fuel ratio F/B control.

In the foregoing air-fuel ratio F/B control, the fuel injection amount (air-fuel ratio) of each cylinder is controlled on the basis of the air-fuel ratio information detected in the exhaust collective part 12*b* of the exhaust manifold 12. However, since the air-fuel ratio actually varies between the respective cylinders, in this embodiment, a cylinder-by-cylinder air-fuel ratio is obtained from the detection value of the A/F sensor 13, and a cylinder-by-cylinder air-fuel ratio control is performed on the basis of the cylinder-by-cylinder air-fuel ratio. The details thereof will be described below.

As shown in FIG. 1, the air-fuel ratio deviation calculated by the air-fuel ratio deviation calculation part 21 is inputted to a cylinder-by-cylinder air-fuel ratio estimation part 24, and the cylinder-by-cylinder air-fuel ratio is estimated in the cylinder-by-cylinder air-fuel ratio estimation part 24. In the cylinder-by-cylinder air-fuel ratio estimation part 24, attention is paid to gas exchange in the exhaust collective part 12*b* of the exhaust manifold 12. A model is created in which a detection value of the A/F sensor 13 is obtained by multiplying histories of cylinder-by-cylinder air-fuel ratios of an inflow gas in the exhaust collective part 12*b* and histories of detection values of the A/F sensor 13 by specified weights respectively and by adding them, and the cylinder-by-cylinder air-fuel ratio is estimated on the basis of the model. A Kalman filter is used as an observer.

More specifically, the model of the gas exchange in the exhaust collective part 12*b* is approximated by the following expression (1). In the expression (1), $y_s$ denotes the detection value of the A/F sensor 13, u denotes an air-fuel ratio of the gas flowing into the exhaust collective part 12*b*, and k1 to k4 denote constants.

$$y_s(t)=k1*u(t-1)+k2*u(t-2)-k3*y_s(t-1)-k4*y_s(t-2) \quad (1)$$

In the exhaust system, there are a first order lag element of the gas inflow and mixture in the exhaust collective part 12*b* and a first order lag element due to the response of the A/F sensor 13. In the expression (1), in consideration of these lag elements, the past two histories are referred to.

When the expression (1) is converted into a state space model, the following expression (2) is obtained. In the expression (2), A, B, C and D denote parameters of the model, Y denotes the detection value of the A/F sensor 13, X denotes a cylinder-by-cylinder air-fuel ratio as a state variable, and W denotes a noise.

$$X(t+1)=AX(t)+Bu(t)+W(t)$$

$$y(t)=CX(t)+Du(t) \quad (2)$$

Further, when the Kalman filter is designed by the expression (2), the following expression (3) is obtained. In the expression (3), X^ (X hat) denotes a cylinder-by-cylinder air-fuel ratio as an estimated value, and K denotes Kalman gain. The notation of X^ (k+1|k) expresses that an estimated value at time k+1 is obtained based on an estimated value at time k.

$$\hat{X}(k+1|k)=A\hat{X}(k|k-1)+K(Y(k)-CA\hat{X}(k|k-1)) \quad (3)$$

As described above, the cylinder-by-cylinder air-fuel ratio estimation part 24 is constructed of the Kalman filter type observer, so that the cylinder-by-cylinder air-fuel ratio can be sequentially estimated as the combustion cycle proceeds. In the structure of FIG. 1, the air-fuel ratio deviation is the input of the cylinder-by-cylinder air-fuel ratio estimation part 24, and in the expression (3), the output Y is replaced by the air-fuel ratio deviation.

In a reference air-fuel ratio calculation part 25, a reference air-fuel ratio is calculated on the basis of the cylinder-by-cylinder air-fuel ratio estimated by the cylinder-by-cylinder air-fuel ratio estimation part 24. Here, an average of the cylinder-by-cylinder air-fuel ratios of all cylinders (average value of the first to fourth cylinders in this embodiment) is made the reference air-fuel ratio, and the reference air-fuel ratio is updated each time a new cylinder-by-cylinder air-fuel ratio is calculated. In a cylinder-by-cylinder air-fuel ratio deviation calculation part 26, a deviation (cylinder-by-cylinder air-fuel ratio deviation) between the cylinder-by-cylinder air-fuel ratio and the reference air-fuel ratio is calculated.

In a cylinder-by-cylinder air-fuel ratio control part 27, a cylinder-by-cylinder correction amount is calculated on the basis of the deviation calculated by the cylinder-by-cylinder air-fuel ratio deviation calculation part 26, and a final injection amount for each cylinder is corrected by the cylinder-by-cylinder correction amount. The more detailed structure of the cylinder-by-cylinder air-fuel ratio control part 27 will be described with reference to FIG. 2.

Figure 2:
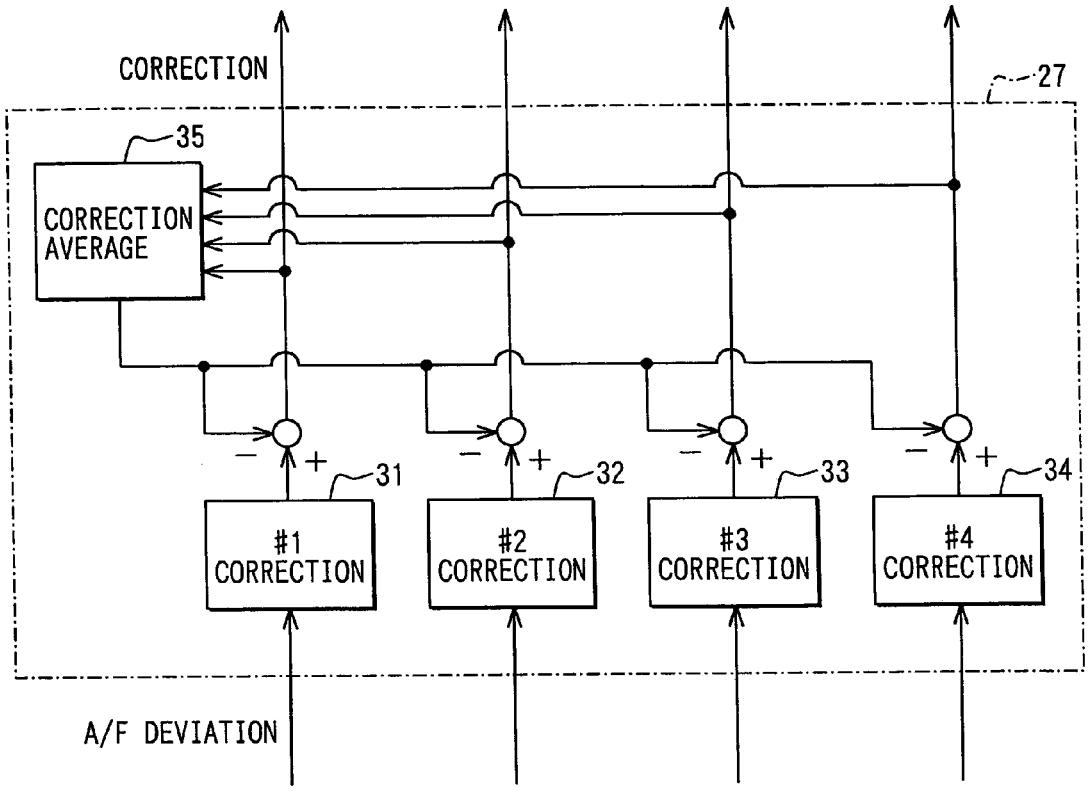
FIG. 2 is a block chart of an air-fuel ratio control part.

In FIG. 2, the cylinder-by-cylinder air-fuel ratio deviations (outputs of the cylinder-by-cylinder air-fuel ratio deviation calculation part 26 of FIG. 1) calculated for the respective cylinders are inputted to correction amount calculation parts 31, 32, 33 and 34 of the first to the fourth cylinders, respectively. In each of the correction amount calculation parts 31 to 34, the cylinder-by-cylinder correction amount is calculated so that variations in air-fuel ratios between the cylinders are resolved on the basis of the cylinder-by-cylinder air-fuel ratio deviation, that is, the cylinder-by-cylinder air-fuel ratio of the pertinent cylinder coincides with the reference air-fuel ratio. At this time, all of the cylinder-by-cylinder correction amounts calculated by the correction amount calculation parts 31 to 34 of the respective cylinders are taken into a correction amount average value calculation part 35, and an average value of the respective cylinder-by-cylinder correction amounts of the first cylinder to the fourth cylinder is calculated. The respective cylinder-by-cylinder correction amounts of the first cylinder to the fourth cylinder are corrected to decrease by the correction amount average value. As a result, the final injection amount of each cylinder is corrected by the cylinder-by-cylinder correction amount after this correction.

Figure 3:
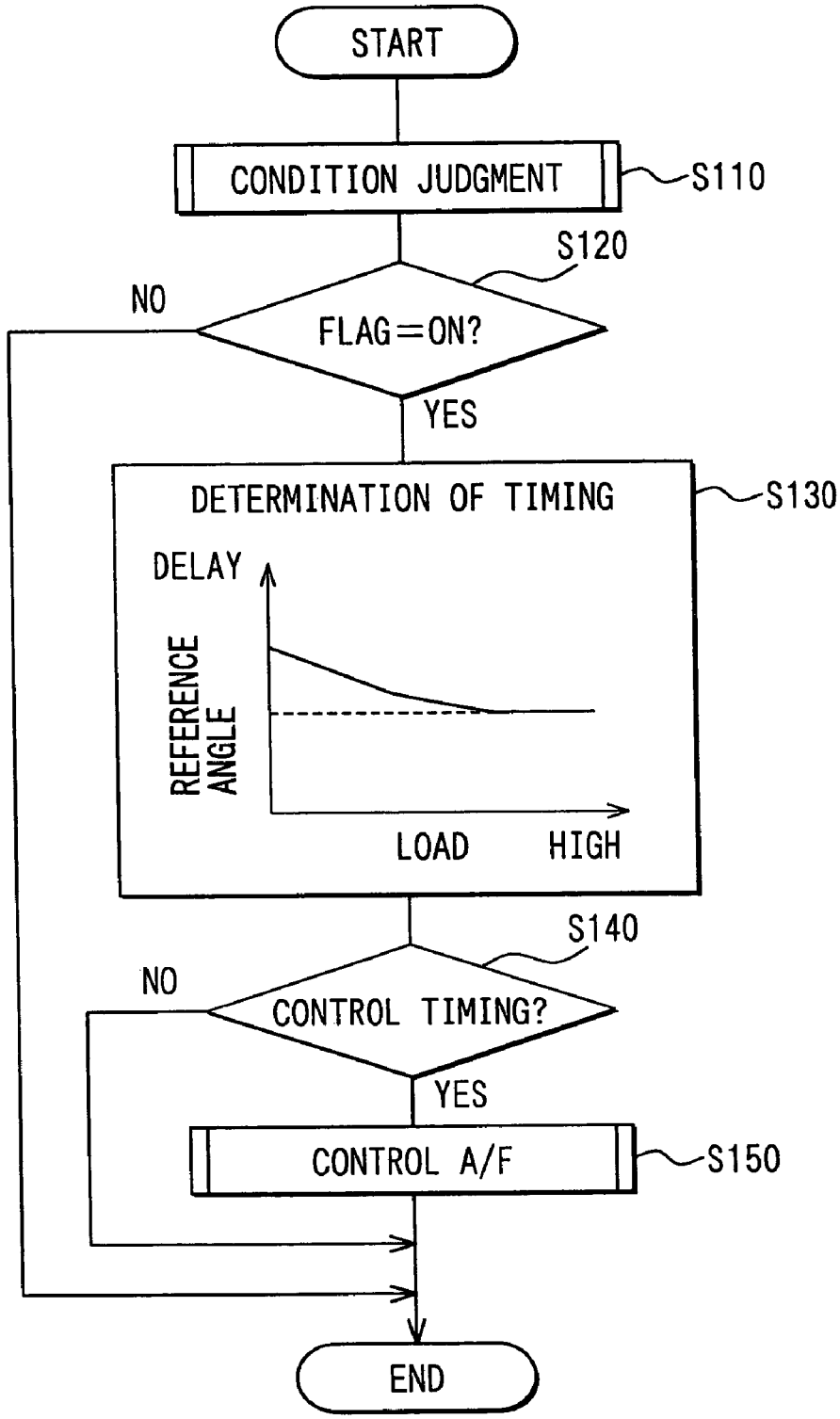
FIG. 3 is a flowchart showing a crank angle synchronization routine.

The foregoing air-fuel ratio deviation calculation part 21, the air-fuel ratio F/B control part 22, the injection amount calculation part 23, the cylinder-by-cylinder air-fuel ratio estimation part 24, the reference air-fuel ratio calculation part 25, the cylinder-by-cylinder air-fuel ratio deviation calculation part 26, and the cylinder-by-cylinder air-fuel ratio control part 27 are realized by a microcomputer in the engine ECU. Next, a series of flows of the cylinder-by-cylinder air-fuel ratio control by the engine ECU will be described with reference to a flowchart. FIG. 3 is a flowchart showing a crank angle synchronization routine performed every specified crank angle (every 30° CA in this embodiment).

Figure 4:
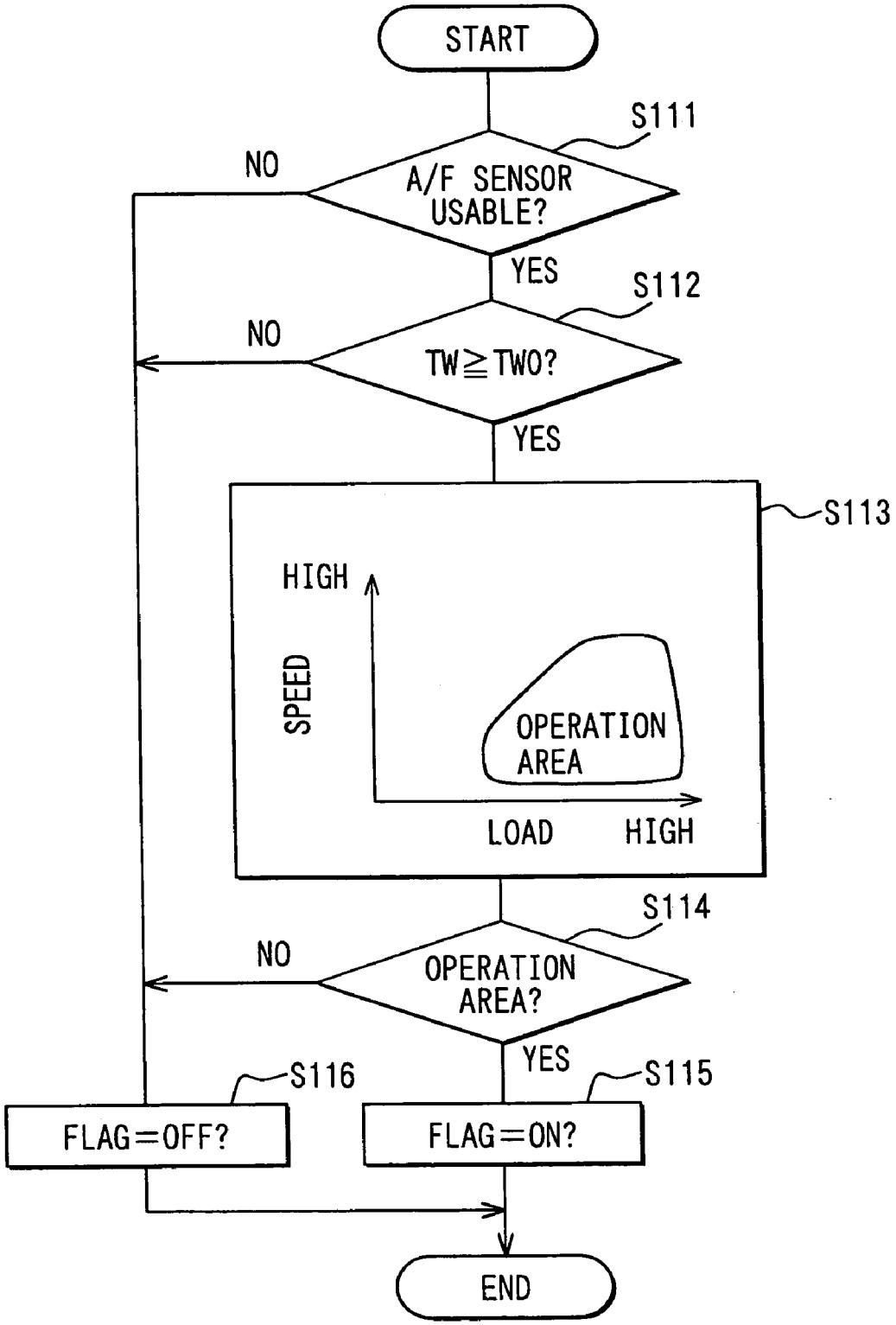
FIG. 4 is a flowchart showing a condition judgment routine.

In FIG. 3, first, at step S110, an execution condition judgment processing for allowing or inhibiting the cylinder-by-cylinder air-fuel ratio control is performed. The execution condition judgment processing will be described in detail with reference to FIG. 4. At step S111, it is judged whether the A/F sensor 13 is in a usable state. Specifically, it is judged that the A/F sensor 13 is activated and is not failed. At step S112, it is judged whether the engine water temperature TW is a specified temperature TWO (for example, 70° C.) or higher. When the A/F sensor 13 is usable and the engine water temperature TW is the specified temperature TWO or higher, the procedure proceeds to step S113.

At step S113, reference is made to an operation area map having a rotation speed and an engine load (for example, intake pipe negative pressure) as parameters, and it is judged whether the present engine operation state is in an execution area. At this time, it is conceivable that in a high revolution area or a low load area, the estimation of the cylinder-by-cylinder air-fuel ratio is difficult, or the reliability of the estimated value is low. Thus, the cylinder-by-cylinder air-fuel ratio control is inhibited in such an operation area, and the execution area is set as shown in the drawing.

When the present engine operation state is in the execution area, an affirmative judgment is made at step S114, and an execution flag is turned ON at step S115. If it is not in the execution area, a negative judgment is made at step S114, and the execution flag is turned OFF at step S116. Thereafter, this processing is ended.

With reference to FIG. 3 again, at step S120, it is judged whether the execution flag is ON, and the procedure proceeds to step S130 under the condition that the execution flag is ON. At step S130, the control timing of the cylinder-by-cylinder air-fuel ratio is determined. At this time, reference is made to a map having the engine load (for example, the intake negative pressure) as a parameter, and a reference crank angle is determined according to the engine load at that time. In the map, the reference crank angle is shifted to a delay angle side in the low load area. That is, since it is conceivable that the exhaust flow velocity becomes low in the low load area, the reference crank angle is set in accordance with the delay, and the control timing is determined on the basis of the reference crank angle.

Figure 6:
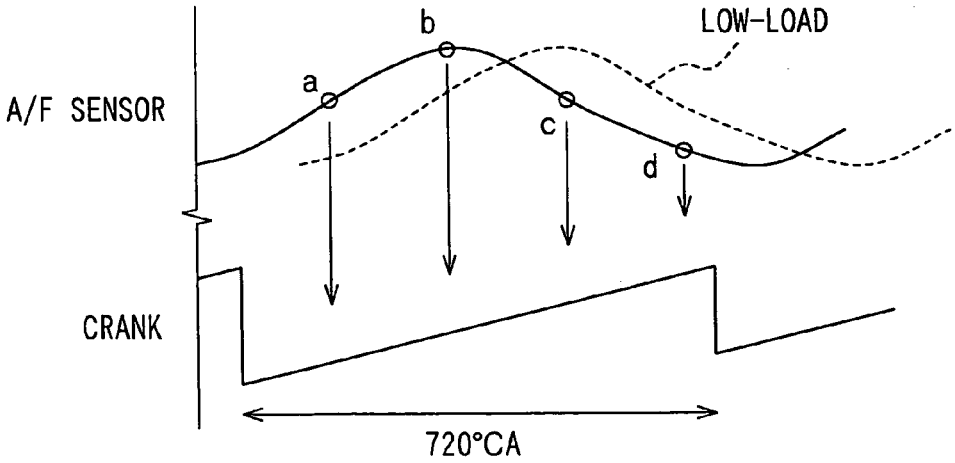
FIG. 6 is a time chart showing a relation between air-fuel sensor signal and a crank angle.

Here, the reference crank angle indicates a reference angle position where the A/F sensor value used for the estimation of the cylinder-by-cylinder air-fuel ratio is acquired, and this varies according to the engine load. With reference to FIG. 6, the A/F sensor value varies according to an individual difference or the like between the cylinders, and has a specified pattern in synchronization with the crank angle. This variation pattern shifts to the delay angle side in the case where the engine load is low. For example, in the case where the A/F sensor value is desired to be obtained at timings of a, b, c and d in the drawing, when the load variation occurs, the A/F sensor value shifts from the originally desired value. However, when the reference crank angle is variably set as described above, the A/F sensor value can be acquired at the optimum timing. However, capture of the A/F sensor value (for example, to perform A/D conversion) itself is not always limited to the timing of the reference crank angle, and the capture may be performed at intervals shorter than the reference crank angle.

Thereafter, the procedure proceeds to step S150 under the condition of the control timing (YES at step S140) of the cylinder-by-cylinder air-fuel ratio, and the cylinder-by-cylinder air-fuel ratio control is performed. The cylinder-by-cylinder air-fuel ratio control will be described with reference to FIG. 5.

Figure 5:
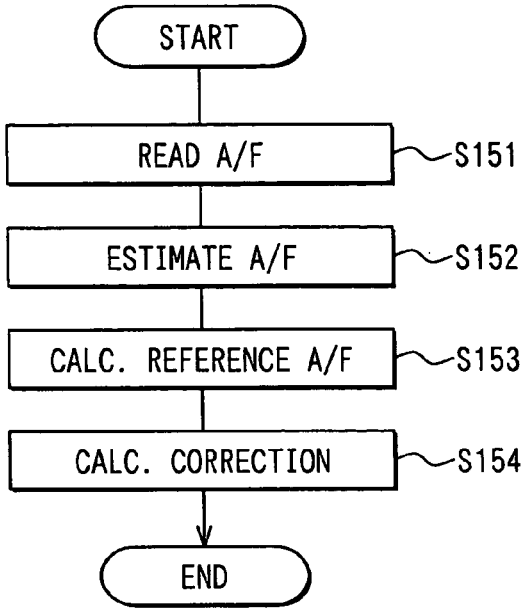
FIG. 5 is a flow chart showing an air-fuel ratio control routine.

In FIG. 5, the air-fuel ratio calculated from the detection signal of the A/F sensor 13 is read at step S151, and the cylinder-by-cylinder air-fuel ratio is estimated at subsequent step S152 on the basis of the read air-fuel ratio. The estimation method of the cylinder-by-cylinder air-fuel ratio is as described before.

Thereafter, at step S153, the average value of the estimated cylinder-by-cylinder air-fuel ratios for all the cylinders (the past four cylinders in this embodiment) is calculated, and the average value is made the reference air-fuel ratio. Finally, at step S154, the cylinder-by-cylinder correction amount is calculated for each cylinder according to the difference between the cylinder-by-cylinder air-fuel ratio and the reference air-fuel ratio. At this time, as described in FIG. 2, the cylinder-by-cylinder correction amounts of all the cylinders are calculated respectively, the average value of all the cylinders is calculated, and a value obtained by subtracting the average value of all the cylinders from the cylinder-by-cylinder correction amount is finally made the cylinder-by-cylinder correction amount. The cylinder-by-cylinder correction amount is used and the final injection amount is corrected for each cylinder.

Figure 7A:
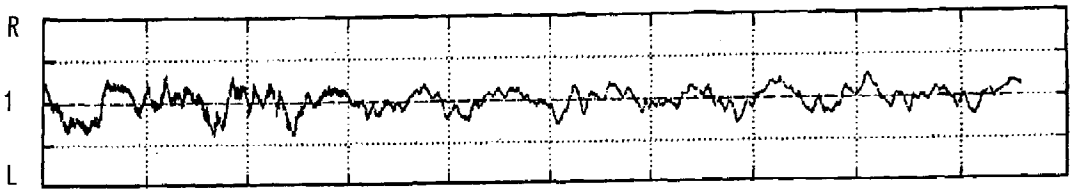
FIGS. 7A to 7D are time charts showing a behavior of air-fuel ratio.
Figure 7B:
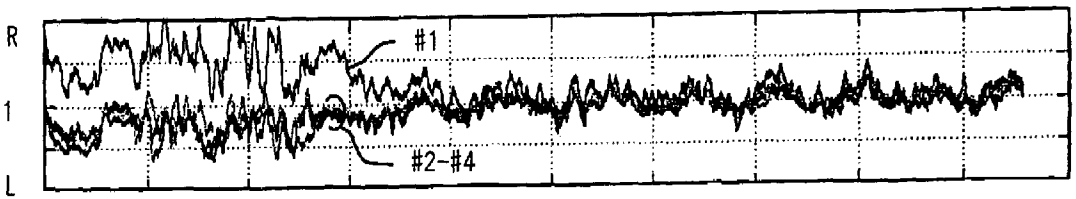
Figure 7C:
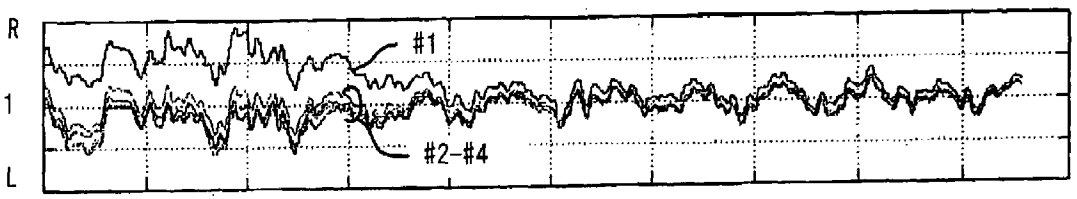
Figure 7D:
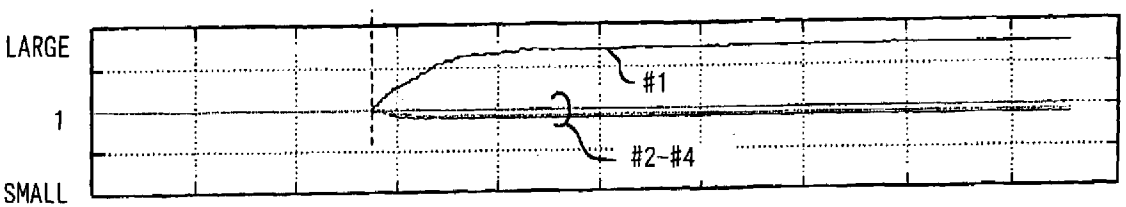

FIGS. 7A to 7D are time charts showing the behavior of air-fuel ratios in the case where the cylinder-by-cylinder air-fuel ratio control is performed. FIG. 7A shows an air-fuel ratio (air-fuel ratio of the collective part) detected by the A/F sensor 13, FIG. 7B shows actually measured values of cylinder-by-cylinder air-fuel ratios measured by A/F sensors attached to the respective cylinders, FIG. 7C shows estimated values of the cylinder-by-cylinder air-fuel ratios of the first to the fourth cylinders, and FIG. 7D shows the behavior of cylinder-by-cylinder correction amounts. In this example, as shown in FIGS. 7B and 7C, among all the four cylinders, only the first cylinder has the behavior of the air-fuel ratio clearly different from the others, and in the drawing, this cylinder is denoted by #1, and the others are denoted by #2 to #4.

As is understood from the comparison between FIGS. 7B and 7C, the estimated values of the cylinder-by-cylinder air-fuel ratios according to this embodiment roughly coincide with the actual air-fuel ratio behavior (actually measured values). At timing t1 and the following shown in FIG. 7D, the cylinder-by-cylinder correction amount is calculated. In such a case, the cylinder-by-cylinder correction amount of the first cylinder is set at the decrease side, and the cylinder-by-cylinder correction amounts of the other cylinders are set at the increase side, and subsequent to t1, the variations in air-fuel ratios between the cylinders are resolved.

According to the embodiment described above in detail, following excellent effects can be obtained.

Since the cylinder-by-cylinder air-fuel ratio is estimated using the model constructed on the basis of the gas inflow and mixture in the exhaust collective part 12*b*, the cylinder-by-cylinder air-fuel ratio reflecting the gas exchange behavior of the exhaust collective part 12*b* can be calculated. Since the mode is the model (autoregressive model) in which the detection value of the A/F sensor 13 is predicted from the past values, differently from the conventional structure using finite combustion histories (combustion air-fuel ratios), it is not necessary to increase the histories in order to improve the accuracy. As a result, the complication of modeling is resolved by using the simple model, and the cylinder-by-cylinder air-fuel ratio can be calculated with high accuracy. As a result, the controllability of the air-fuel ratio control is improved.

Since the Kalman filter type observer is used for the estimation of the cylinder-by-cylinder air-fuel ratio, the performance of noise resistance is improved, and the estimation accuracy of the cylinder-by-cylinder air-fuel ratio is improved.

Since the structure is made such that the control timing of the cylinder-by-cylinder air-fuel ratio is variably set according to the engine load, the A/F sensor value can be acquired at the optimum timing, and the estimation accuracy of the cylinder-by-cylinder air-fuel ratio is improved.

In the air-fuel ratio F/B control, the cylinder-by-cylinder air-fuel ratio deviation as the variation amount of air-fuel ratios between the cylinders is calculated on the basis of the cylinder-by-cylinder air-fuel ratio (estimated value), and the cylinder-by-cylinder correction amount is calculated for each pertinent cylinder according to the calculated cylinder-by-cylinder air-fuel ratio deviation. Thus, an error in air-fuel ratio control due to the variation amount of the air-fuel ratios can be decreased, and the air-fuel ratio control with high accuracy can be realized.

In calculation of the cylinder-by-cylinder correction amount, since the average value of the cylinder-by-cylinder correction amounts of all the cylinders is calculated, and the cylinder-by-cylinder correction amount for each cylinder is corrected to decrease by the average value of all the cylinders, the interference with the normal air-fuel ratio F/B control can be avoided. That is, in the normal air-fuel ratio F/B control, the air-fuel ratio control is performed so that the air-fuel ratio detection value in the exhaust collective part 12*b* coincides with the target value. On the other hand, in the cylinder-by-cylinder air-fuel ratio control, the air-fuel ratio control is performed so that the variations in air-fuel ratios between the cylinders are absorbed.

(Second Embodiment)

In the first embodiment, the cylinder-by-cylinder air-fuel ratio is estimated on the basis of the detection values of the A/F sensor 13, and the cylinder-by-cylinder air-fuel ratio control is performed so as to eliminate the variations in air-fuel ratios between the cylinders on the basis of the cylinder-by-cylinder air-fuel ratio (estimated value). However, according to an engine operation state, there is a case where the estimation of the cylinder-by-cylinder air-fuel ratio becomes difficult. In the case where the cylinder-by-cylinder air-fuel ratio cannot be estimated, the cylinder-by-cylinder air-fuel ratio control cannot be performed, and therefore, there is a fear that the variations in air-fuel ratios between the cylinders cannot be resolved. For example, the situation as stated above occurs immediately after the starting of an engine, or at the time of high revolution or low load operation. In this embodiment, the variations in air-fuel ratios between the cylinders are learned, a cylinder-by-cylinder air-fuel ratio learning value (air-fuel ratio learning value) obtained by the learning is stored in a backup memory, such as a standby RAM, for holding storage contents even after the ignition is turned OFF, and the cylinder-by-cylinder air-fuel ratio learning value is suitably used for the air-fuel ratio control. As the backup memory, a nonvolatile memory such as EEPROM can also be used.

Figure 8:
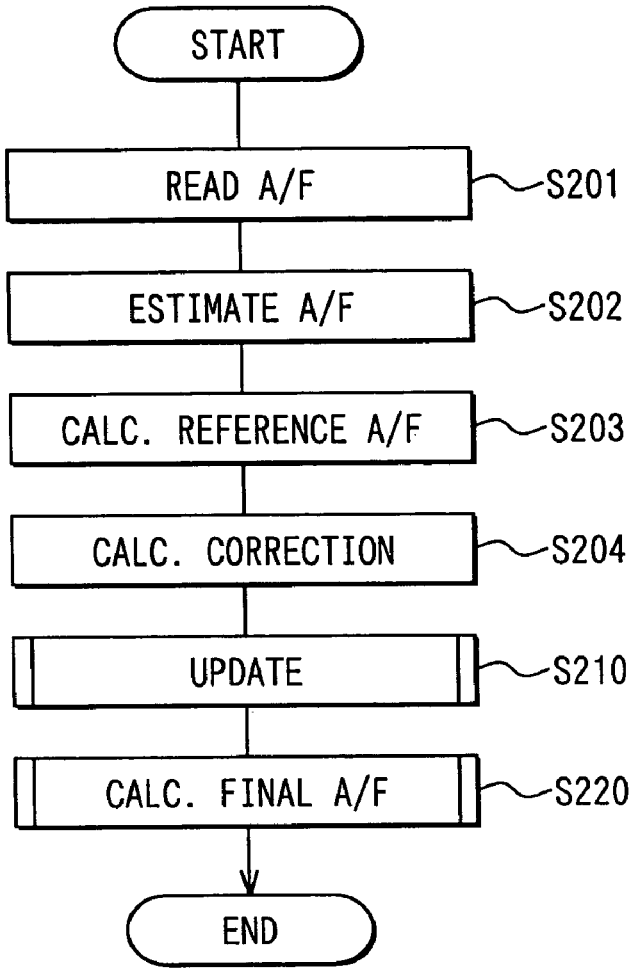
FIG. 8 is a flow chart showing an air-fuel ratio control according to a second embodiment of the present invention.

FIG. 8 is a flowchart showing a cylinder-by-cylinder air-fuel ratio control processing in this embodiment, and the control processing is performed instead of the processing of FIG. 5. Incidentally, steps S201 to S204 of FIG. 8 are the same processing as steps S151 to S154 of FIG. 5.

In FIG. 8, first, at steps S201 to S204, a cylinder-by-cylinder correction amount is calculated. That is, as described above, reading of an air-fuel ratio (step S201), estimation of a cylinder-by-cylinder air-fuel ratio (step S202), calculation of a reference air-fuel ratio (step S203), and calculation of a cylinder-by-cylinder correction amount (step S204) are performed. As described in FIG. 2, the cylinder-by-cylinder correction amounts are calculated from the differences between the average value (average value of all cylinders) of the correction amounts of the first to the fourth cylinders calculated on the basis of the cylinder-by-cylinder air-fuel ratio deviations and the correction amounts of the first to the fourth cylinders.

Thereafter, at step S210, an update processing of the cylinder-by-cylinder learning value is performed, and at subsequent step S220, a final fuel injection amount is calculated for each cylinder by causing the reflection of the cylinder-by-cylinder learning value or the like to occur. However, the details of step S210 and S220 will be described later.

Figure 9:
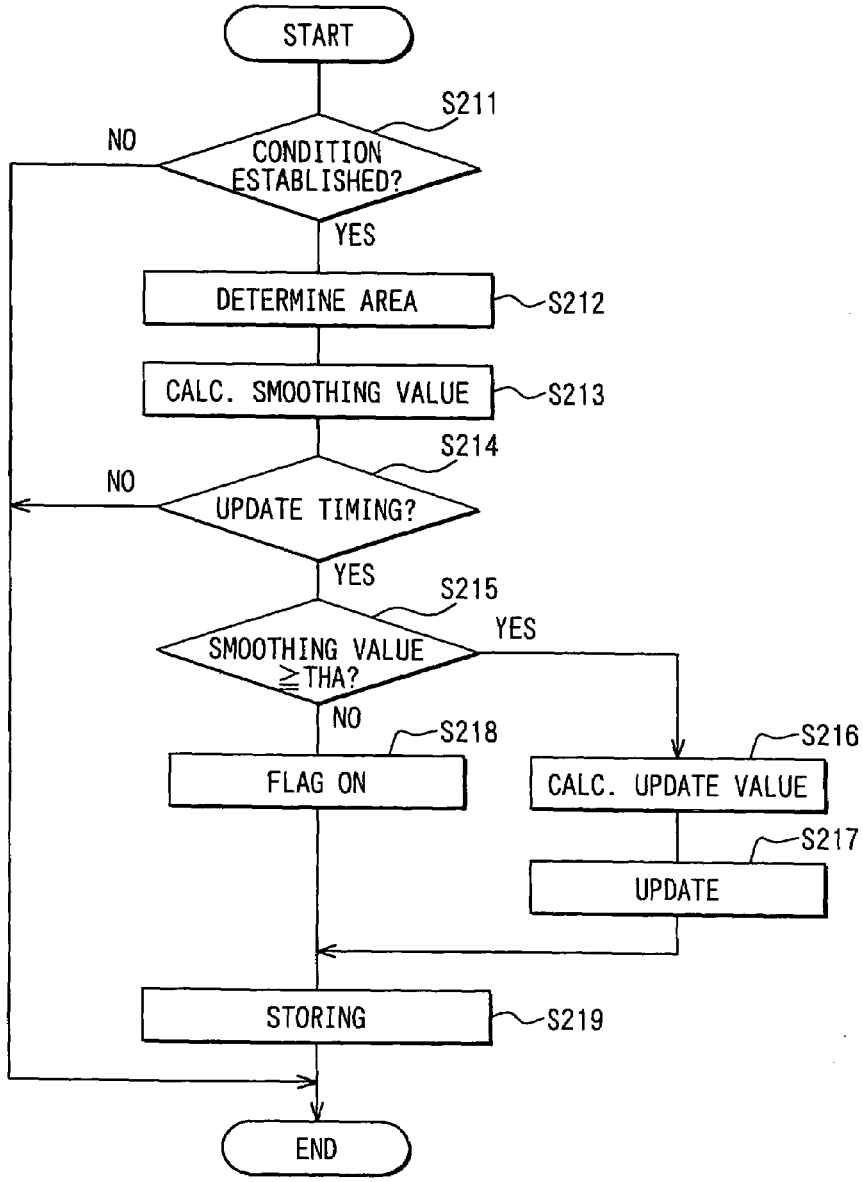
FIG. 9 is a flow chart showing an update processing.

FIG. 9 is a flowchart showing the update processing of the cylinder-by-cylinder learning value at step S210. In FIG. 9, at step S211, it is judged whether learning execution conditions are established. Specifically, (a) that the cylinder-by-cylinder air-fuel ratio control is performed at present, (b) that the engine water temperature is a specified temperature or higher (for example, minus 10° C. or higher), (c) that the variation amount of air-fuel ratio is a specified value or less, and the air-fuel ratio stable condition is established, are made learning execution conditions. In the case where all of the above conditions (a) to (c) are satisfied, the learning execution conditions are regarded as being established. In the case where the learning execution conditions are established, the learning value update is allowed, and in the case where the learning execution conditions are not established, the learning value update is inhibited.

In order to satisfy the condition (a), it is the premise that the execution condition of the cylinder-by-cylinder air-fuel ratio control is established. As described in the execution condition judgment processing of FIG. 4, the condition (a) includes that the A/F sensor 13 is activated and is not failed.

Figures 11A, 11B, 11C, 11D:
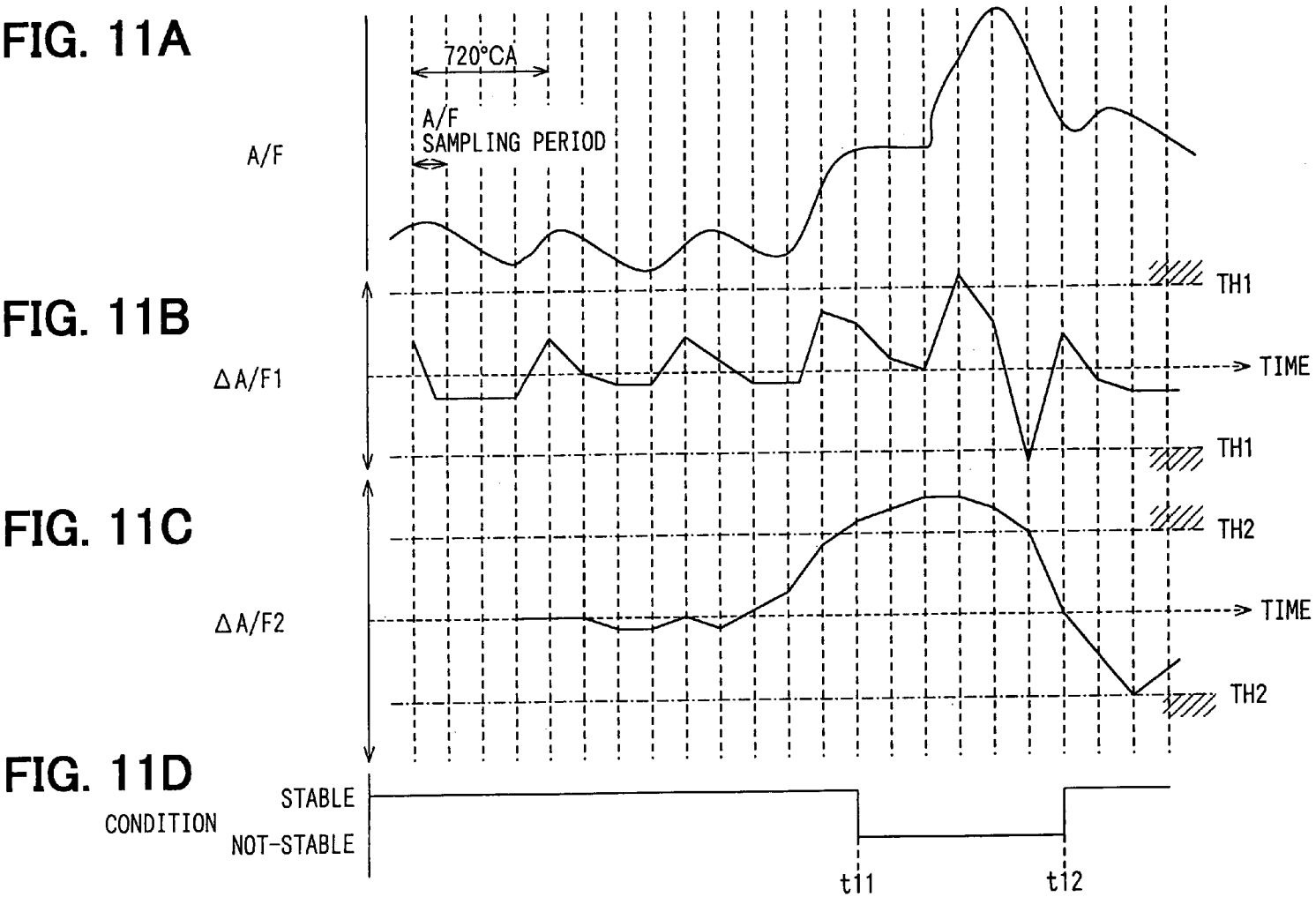
FIGS. 11A to 11D are time charts for explaining a judging reference of air-fuel stable condition.

The condition (c) will be described with reference to FIG. 11. That is, in the case where a difference ΔA/F1 (absolute value) between a present value and a last value of the detected air-fuel ratio (A/F) is less than a specified value TH1 , and a difference ΔA/F2 (absolute value) between a present value of the detected air-fuel ratio and 720° CA former value is less than a specified value TH2, it is judged that the air-fuel ratio stable condition (c) is established. For example, when the detected air-fuel ratio is changed as shown in FIG. 11A, ΔA/F1 and ΔA/F2 become as shown in FIGS. 11B and 11C, and as a result, it is judged that the air-fuel ratio stable condition is established in a period other than t11 to t12.

In addition to the conditions (a) to (c), a condition, such as the time of high revolution or the time of low load, where estimation accuracy of the cylinder-by-cylinder air-fuel ratio is considered to be lowered is set, and the learning value update may be inhibited under such a condition. By regulating the learning execution condition as stated above, it becomes possible to prevent erroneous learning of the cylinder-by-cylinder learning value.

In the case where the learning execution conditions are established, the procedure proceeds to step S212, and a learning area in which the forthcoming learning is to be performed is determined while for example, engine rotation speed and load are used as parameters. Thereafter, at step S213, a smoothing value of a cylinder-by-cylinder correction amount is calculated for each cylinder. Specifically, the correction amount smoothing value is calculated using the following expression. Where, K denotes a smoothing coefficient, and for example, K=0.25.

correction amount smoothing value=last smoothing value+K×(current correction amount−last smoothing value)

Thereafter, at step S214, it is judged whether the current processing is at the update timing of the cylinder-by-cylinder learning value. This update timing may be such that the update period of the cylinder-by-cylinder learning value is set to be longer than at least the calculation period of the cylinder-by-cylinder correction amount. For example, when a specified time set in a timer or the like has passed, the judgment of the update timing is made. If the processing is at the update timing of the cylinder-by-cylinder learning value, the procedure proceeds to subsequent step S215, and if not the update timing, this processing is ended as it is.

At step S215, it is judged whether the absolute value of the calculated correction amount smoothing value for each cylinder is a specified value THA or higher. In this embodiment, the specified value THA is an equivalent value in a case where a difference between an average value of cylinder-by-cylinder air-fuel ratios (estimated values) of all cylinders and the cylinder-by-cylinder air-fuel ratio is 0.01 or more in excess air factor λ.

Figure 12:
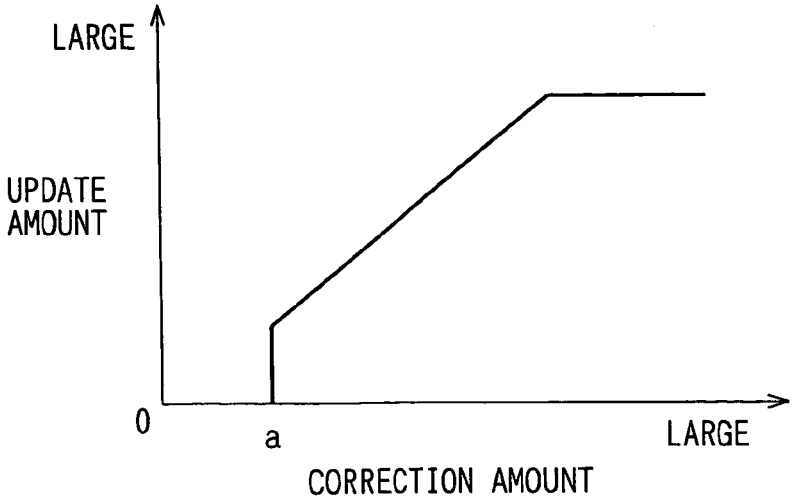
FIG. 12 is a graph showing a relation between a correction amount smoothing value and a learned value update amount.

If the correction amount smoothing value (absolute value) ≧THA, the procedure proceeds to step S216, and a learning value update amount is calculated. At this time, the learning value update amount is calculated using, for example, the relation of FIG. 12 and on the basis of the correction amount smoothing value at that time. Basically, as the correction amount smoothing value becomes large, the learning value update amount becomes large. In the relation of FIG. 12, if the correction amount smoothing value<a, the learning value update amount is 0, and the value "a" corresponds to the specified value THA at step S215. Thereafter, at step S217, the update processing of the cylinder-by-cylinder learning value is performed. That is, the learning value update amount is added to the former value of the cylinder-by-cylinder learning value, and the result is made a new cylinder-by-cylinder learning value.

If the correction amount smoothing value (absolute value) <THA, the procedure proceeds to step S218, and a learning completion flag is turned ON.

Figure 13:
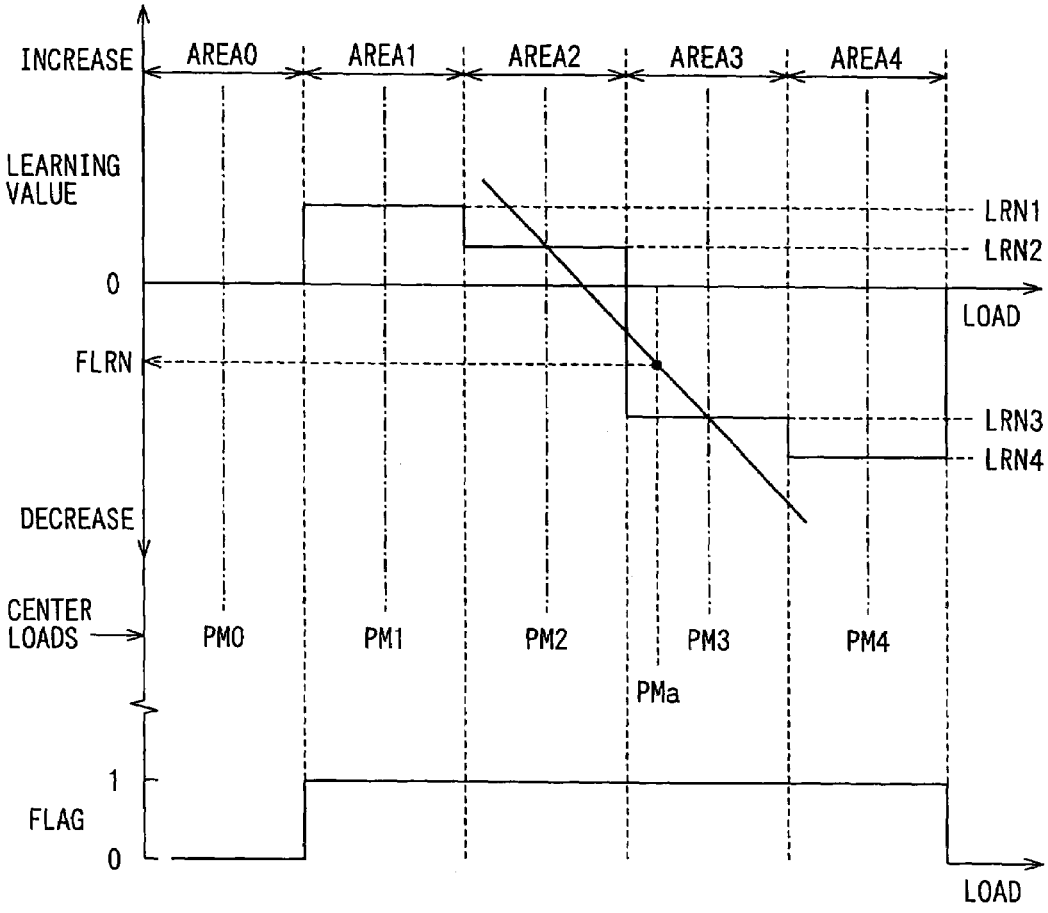
FIG. 13 is a graph for explaining a learned value and a flag.

Finally, at step S219, the cylinder-by-cylinder learning value and the learning completion flag are stored in the standby RAM. At this time, the cylinder-by-cylinder learning value and the learning completion flag are stored for each of plural divided operation areas. The outline is shown in FIG. 13. In FIG. 13, the engine operation area is divided into an area 0, an area 1, an area 2, an area 3 and an area 4 by load level (for example, intake pipe pressure PM), and the cylinder-by-cylinder learning value and the learning completion flag are stored for each of the areas 0 to 4. The area 0 indicates a state where learning is not completed, and the areas 1 to 4 indicate states where learning is completed, and the cylinder-by-cylinder learning values of the areas 1 to 4 are made LRN1, LRN2, LRN3 and LRN4. Area center loads of the respective areas 0 to 4, that is, loads typifying the areas are made PM0, PM1, PM2, PM3 and PM4. As the area division, an engine speed, water temperature, intake air amount, required injection amount and the like can be suitably used in addition to the load.

Figure 10:
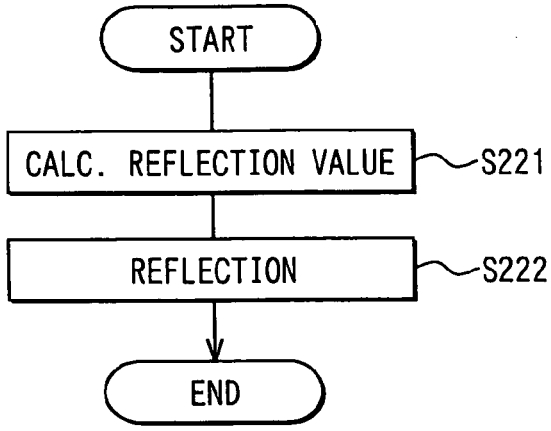
FIG. 10 is a flowchart showing a learned value reflection processing.

FIG. 10 is a flowchart showing a reflecting processing of the cylinder-by-cylinder learning value at step S220 of FIG.

8. In FIG. 10, at step S221, a learning reflection value is calculated on the basis of the engine operation state at that time. At this time, the cylinder-by-cylinder learning values stored for the respective operation areas in FIG. 13 are used, and the learning reflection value is obtained by linear interpolation of the cylinder-by-cylinder learning values between the areas. The way of obtaining the learning reflection value will be described with reference to FIG. 13.

As an example, in the case where the load at that time is PMa, a learning reflection value FLRN is calculated using the cylinder-by-cylinder learning values LRN 2 and LRN3 of the areas 2 and 3 and the center loads PM2 and PM3 of the areas 2 and 3 and by the following expression (4).

$$FLRN=(PM3-Pma/PM3-PM2)\times LRN3+(Pma-PM2/PM3-PM2)\times LRN\ 2 \quad (4)$$

In the outside of a previously set area (learning non-execution area), it is appropriate that a learning reflection value is calculated using a cylinder-by-cylinder learning value corresponding to an area boundary part. For example, in FIG. 13, when the areas 0 to 4 are learning execution areas, and the outside is the learning non-execution area, the learning reflection value of the learning non-execution area is calculated using the cylinder-by-cylinder learning values of the areas 0 and 4. By this, even in the learning non-execution area such as a high revolution and high load area, the reflection of the cylinder-by-cylinder learning value becomes possible.

At step S222, the calculated learning reflection value is reflected in a final fuel injection amount TAU. Specifically, the fuel injection amount TAU is calculated using a basic injection amount TP, an air-fuel ratio correction coefficient FAF, a cylinder-by-cylinder correction amount FK, a learning reflection value FLRN, and other correction coefficient FALL (TAU=TP×FAF×FK×FLRN×FALL). At this time, in order to prevent the FAF correction and the learning reflection from interfering each other, it is appropriate that the air-fuel ratio correction coefficient FAF is corrected to decrease by the learning reflection value FLRN.

Figure 14:
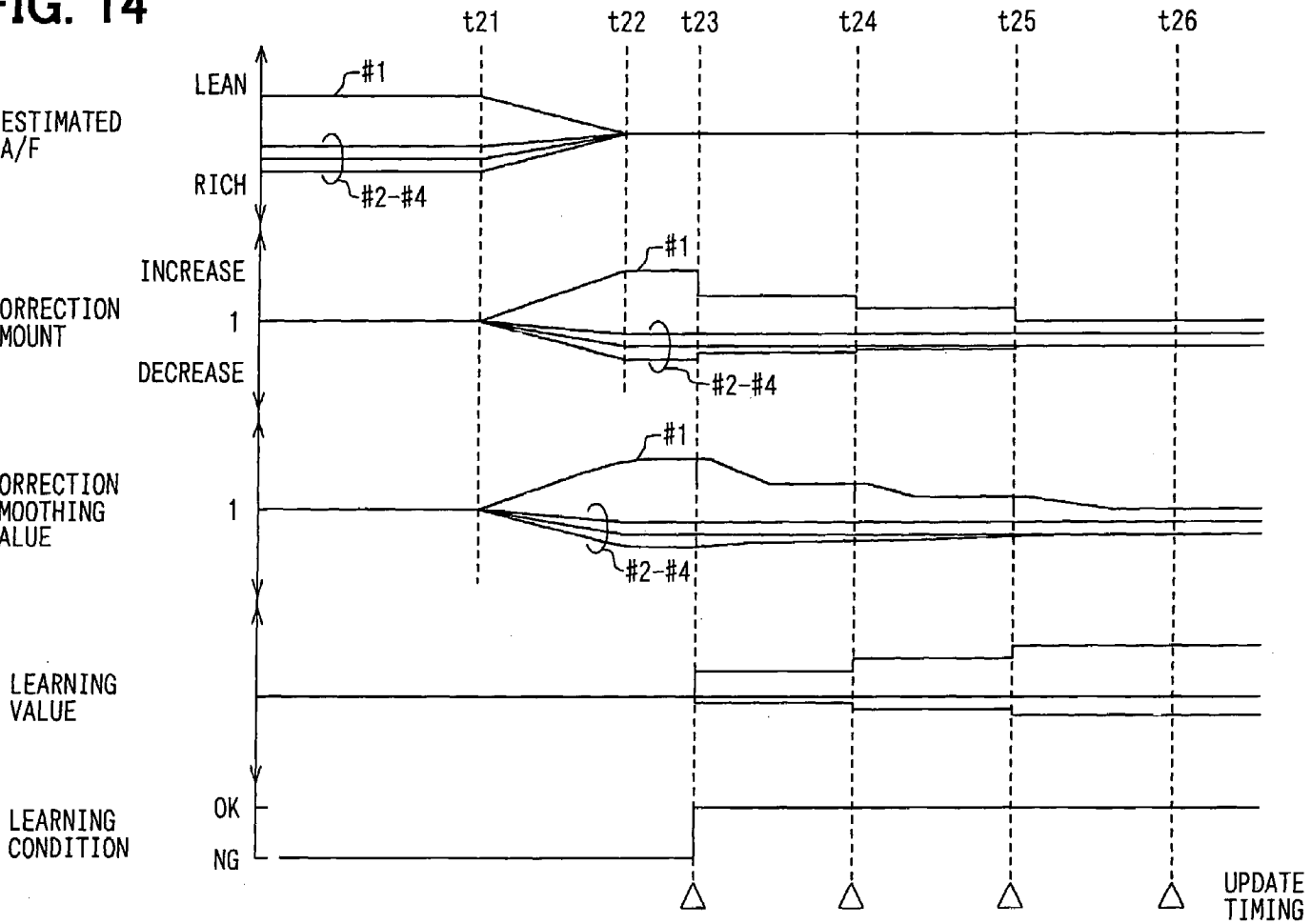
FIG. 14 is a time chart for explaining update process of learned value.

FIG. 14 is a time chart for explaining a process in which the cylinder-by-cylinder learning value is updated. In FIG. 14, among the four cylinders, the cylinder-by-cylinder air-fuel ratio of only the first cylinder is apparently different from the other cylinders, and in the drawing, this cylinder is denoted by #1, and the other cylinders are denoted by #2 to #4.

In FIG. 14, at timing t21 and the following, cylinder-by-cylinder correction amounts are calculated, and the cylinder-by-cylinder correction amounts corresponding to the variations in air-fuel ratios between the cylinders are calculated as shown in the drawing. At timing t22, the variations in air-fuel ratios between the cylinders are resolved, and the cylinder-by-cylinder air-fuel ratios are made almost uniform.

Thereafter, at timing t23, the learning execution conditions are established, and subsequently, the calculation of the cylinder-by-cylinder learning value and the update processing are performed. In the drawing, timings t23, t24, t25, t26 are learning update timings. Since the learning update period is longer than the calculation period of the cylinder-by-cylinder correction amount, erroneous learning due to abrupt update of the cylinder-by-cylinder learning value is suppressed. At the respective timings t23 to t26, the cylinder-by-cylinder learning value is updated by a value corresponding to the magnitude of the correction amount smoothing value of each cylinder at each time. When the correction amount smoothing value of each cylinder becomes less than the specified value THA, learning is regarded as being completed, and the learning completion flag is set (illustration is omitted). At this time, since the cylinder-by-cylinder learning value is updated at specified intervals, it is conceivable that the cylinder-by-cylinder learning value cannot successively correspond to the variation between the cylinders. However, the variation between the cylinders is actually resolved by the air-fuel ratio correction coefficient FAF or the like.

According to the second embodiment, since the cylinder-by-cylinder learning value (air-fuel ratio learning value) is suitably calculated according to the cylinder-by-cylinder correction amount of each cylinder, and is stored in the standby RAM, even in the case where the estimated value of the cylinder-by-cylinder air-fuel ratio is not obtained, the cylinder-by-cylinder air-fuel ratio control becomes possible, and the variations in the air-fuel ratios between the cylinders can be resolved.

Since the update width (learning value update amount) of the cylinder-by-cylinder learning value per one time is variably set according to the cylinder-by-cylinder correction amount at each time, even in the case where the cylinder-by-cylinder correction amount is large (that is, the variation in the air-fuel ratio between the cylinders is large), the learning can be completed in a relatively short time. In the case where the variation in the air-fuel ratio between the cylinders is resolved, and the cylinder-by-cylinder correction amount becomes small, the cylinder-by-cylinder learning value can be updated little by little, that is, carefully, and therefore, the accuracy of the learning can be raised.

(Third Embodiment)

There is conventionally known an evaporated fuel discharge apparatus in which an evaporated fuel generated in a fuel tank is once adsorbed by a canister (fuel adsorbing apparatus), and then, the fuel is discharged (purged) to an engine intake system and is burned in a combustion chamber. In a control system provided with this apparatus, it is proposed to correct a fuel injection amount by a fuel injection valve (fuel injection device) according to a discharge amount (purge amount) of the evaporated fuel. However, in the case of a multi-cylinder internal combustion engine, there is a problem that a purge amount distributed to each cylinder varies due to difference in shape, length and the like of an intake passage from the canister to the combustion chamber, and as a result, air-fuel ratio F/B control becomes unstable.

In JP-A-2001-173485, a purge distribution rate between cylinders is previously considered, and a purge distribution correction coefficient is set, and an injection amount is corrected for each cylinder by using this correction coefficient. However, in such a structure, the purge distribution rate between the cylinders is merely set at a guess. That is, parameters such as a purge distribution correction coefficient are basically calculated on the basis of data obtained by simulation or experiments. Accordingly, the structure can not deal with a difference among engines and secular change, and it has not been possible to prevent deterioration of emission over a long period of time and to prevent deterioration of operation performance due to variation in purge distribution between cylinders.

In this embodiment, on the basis of the cylinder-by-cylinder correction amount (including cylinder-by-cylinder learning value calculated from the cylinder-by-cylinder correction amount) at the time of purge execution/purge stop, a cylinder-by-cylinder distribution rate is calculated, and the cylinder-by-cylinder distribution rate is reflected on the purge control. By this, emission is improved, and deterioration of driving performance is prevented.

Figure 15:
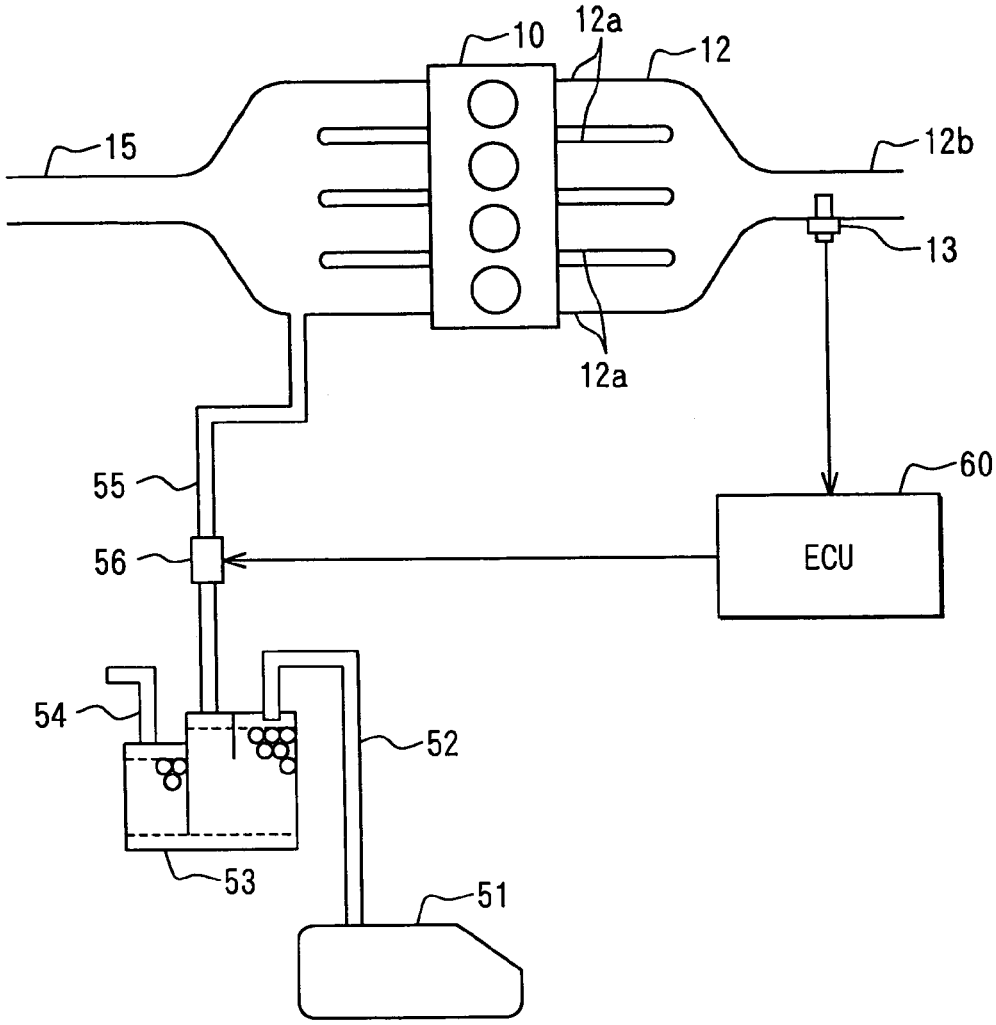
FIG. 15 is a schematic view of a system according to a third embodiment of the present invention.

Here, the structure of an engine provided with an evaporated fuel release device will be described with reference to FIG. 15. FIG. 15 shows the structure in which the evaporated fuel release device is added to the structure of FIG. 1.

In FIG. 15, one end of a conduit 52 is connected to a fuel tank 51, and a canister 53 is connected to the other end of the conduit 52. Many adsorbents made of, for example, activated carbon and for adsorbing evaporated fuel generated in the fuel tank 51 are contained in the canister 53, and an atmospheric air introduction hole 54 for introducing the outer air is provided in a part thereof. The canister 53 is connected to a surge tank of an intake pipe 15 through a purge pipe 55, and an electromagnetic driving purge control valve 56 is provided in the midway of the purge pipe 55. When the purge control valve 56 is opened, an intake negative pressure is applied to the purge pipe 55, and at that time, the atmospheric air is introduced into the canister 53 through the atmospheric air introduction hole 54, the adsorbed fuel is separated from the adsorbents in the canister 53, and is released to the intake pipe 15 (surge tank).

A detected signal of an A/F sensor 13 and other various sensor-detected signals are inputted to an engine ECU 60. As described in the respective foregoing embodiments, the engine ECU 60 suitably performs estimation of a cylinder-by-cylinder air-fuel ratio, air-fuel ratio F/B control using the cylinder-by-cylinder air-fuel ratio, and calculation of a cylinder-by-cylinder learning value. The purge control valve 56 is duty driven on the basis of the engine operation state and the like, and the purge amount of the evaporated fuel is suitably controlled.

In this embodiment, when the cylinder-by-cylinder learning value is updated, it is judged whether the learning value is one at the time of purge execution or at the time of purge stop, and the cylinder-by-cylinder learning value is updated concerning each of the purge execution time/purge stop time. Specifically, the engine ECU 60 performs an update processing of the cylinder-by-cylinder learning value shown in FIG. 16 instead of FIG. 9. However, FIG. 16 includes also the same processing as FIG. 9, and the detailed description of the duplicate processing will be omitted.

Figure 16:
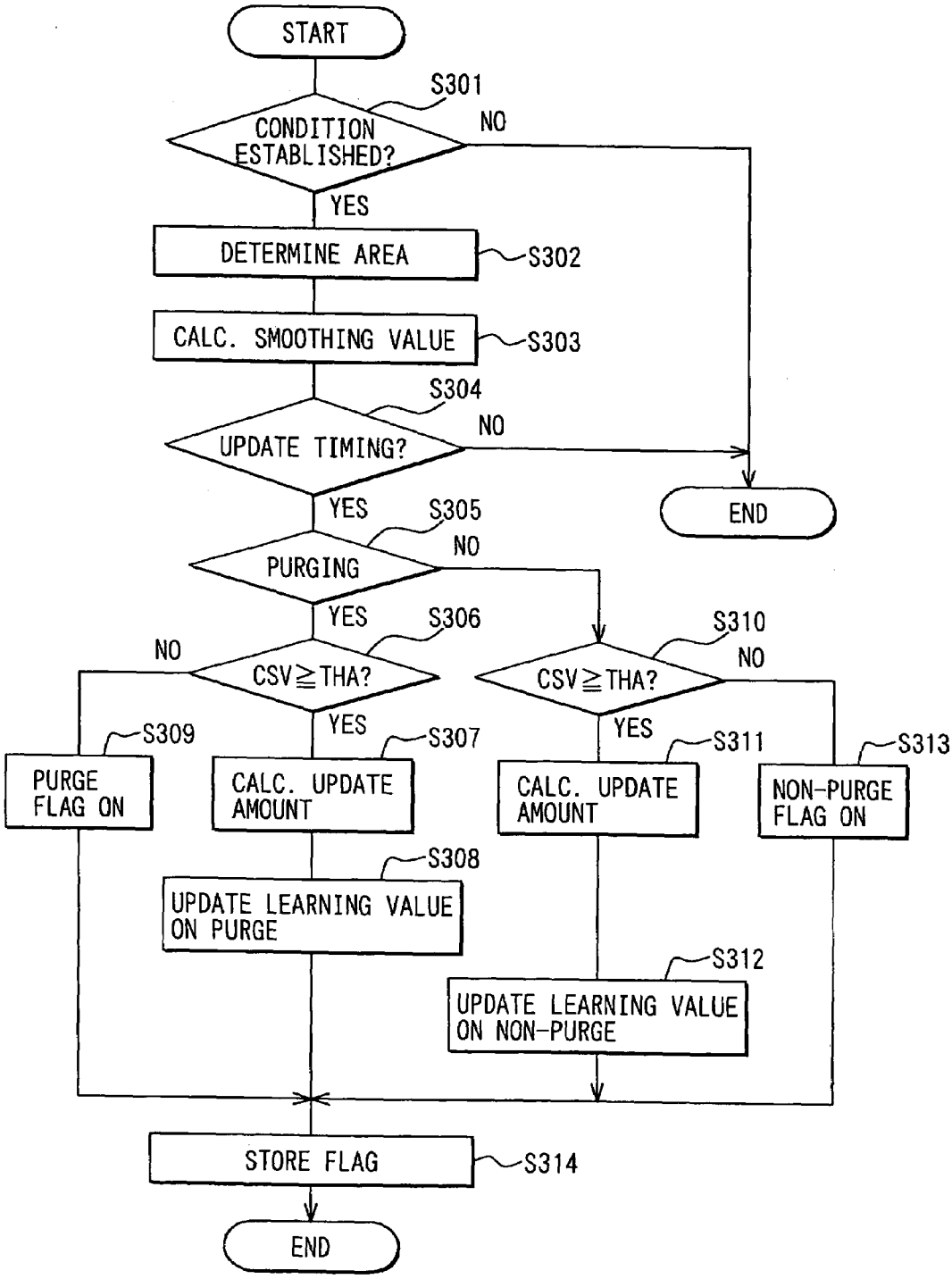
FIG. 16 is a flow chart showing an update processing of learned value.

In FIG. 16, at step S301, it is judged whether execution conditions of learning are established (similar to step S211). In the case where the learning execution conditions are established, at step S302, a learning area in which learning is to be performed this time is determined, and at subsequent step S303, a smoothing value of a cylinder-by-cylinder correction amount is calculated for each cylinder-(similar to the steps S212 and S213). At step S304, it is judged whether this processing is at an update timing of a cylinder-by-cylinder learning value (similar to the step S214).

In the case of the update timing of the cylinder-by-cylinder learning value, at step S305, it is judged whether a purge is being performed at present. If the purge is being performed, at steps S306 to S309, an update processing of a purge executing cylinder-by-cylinder learning value is performed. If the purge is being stopped, an update processing of a purge stopping cylinder-by-cylinder learning value is performed at steps S310 to S313.

That is, when the purge is being performed, at step S306, it is judged whether a relation of a correction amount smoothing value CSV (absolute value)≧THA is established, and in a case of YES, the procedure proceeds to step S307, and a learning value update amount is calculated (similar to the steps S215 and S216). At subsequent step S308, the learning value update amount is added to the last value of the purge executing cylinder-by-cylinder learning value, and the result is made a new purge executing cylinder-by-cylinder learning value and the update is made. If a relation of a correction amount smoothing value CSV<THA is established, the procedure proceeds to step S309, and a purge executing learning completion flag is turned ON.

On the other hand, when the purge is being stopped, at step S310, it is judged whether a relation of a correction amount smoothing value CSV≧THA is established, and in a case of YES, the procedure proceeds to step S311, and a learning value update amount is calculated (similar to steps S215 and S216). At subsequent step S312, the learning value update amount is added to the last value of the purge stopping cylinder-by-cylinder learning value, and the result is made a new purge stopping cylinder-by-cylinder learning value and the update is made. If a relation of a correction amount smoothing value (absolute value)<THA is established, the procedure proceeds to step S313, and a purge stopping learning completion flag is turned ON.

Finally, at step S314, the cylinder-by-cylinder learning values during purge execution/purge stop and the respective learning completion flags are stored in a standby RAM. At this time, the respective cylinder-by-cylinder learning values and the respective learning completion flags are stored for each of plural divided engine operation areas. Alternatively, the respective cylinder-by-cylinder learning values and the respective learning completion flags may be stored for each of areas sorted according to a purge condition (purge amount, purge concentration, etc.) on a case-by-case basis.

Figure 17:
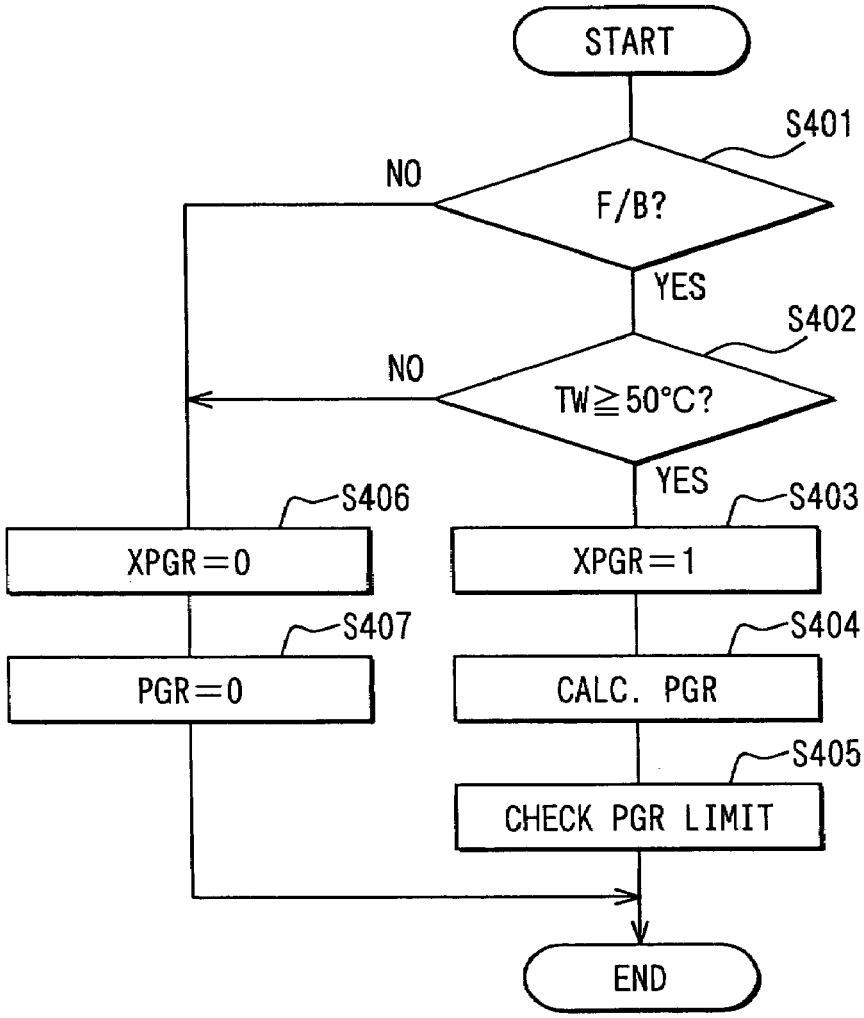
FIG. 17 is a flow chart showing a purge ratio calculation process.

Next, a purge control procedure for releasing the evaporated fuel will be described. FIG. 17 is a flow chart showing a calculation processing of a purge rate, and this processing is performed at a specified time period (for example, 4 ms period) and in a base routine of the engine ECU 60.

In FIG. 17, first, at step S401, it is judged whether the air-fuel ratio F/B control is being performed at present. At this time, when the air-fuel ratio F/B control is performed under conditions that for example, the engine is not in a starting time, the A/F sensor 13 is activated, and fuel is not cut, an affirmative judgment is made at step S401. At subsequent step S402, it is judged whether engine water temperature TW is a specified temperature (for example, 50° C.) or higher. In the case where the judgments at both steps S401 and S402 are YES, the procedure proceeds to step S403, and a purge execution flag XPGR is set to 1.

Thereafter, at step S404, a calculation processing of a purge rate PGR is performed. At this time, it is appropriate that the purge rate PGR is calculated on the basis of the air-fuel ratio correction coefficient. For example, the purge rate PGR is increased/decreased according to the degree of separation of the air-fuel ratio correction coefficient with respect to a reference value (1.0). More specifically, with respect to the reference value of the air-fuel ratio correction coefficient as the center, a first area including the reference value, and a second area and a third area sequentially becoming distant from this first area are provided, and when the air-fuel ratio correction coefficient is in the first area, the purge rate PGR is increased by a specified value, when it is in the second area, the purge rate PGR is held as it is, and when it is in the third area, the purge rate PGR is decreased by a specified value. That is, when the air-fuel ratio correction coefficient is in the vicinity of the reference value and is stabilized, the purge rate PGR is increased, and when the air-fuel ratio correction coefficient becomes much distant from the reference value, the purge rate PGR is decreased reversely.

Thereafter, at step S405, an upper and lower limit check of the purge rate PGR is performed. At this time, for example, the PGR upper limit value is made large as the purge execution time becomes long (however, for example, the maximum is made 5 minutes). Alternatively, the PGR upper limit value may be set by engine water temperature or the like.

In the case where the judgment of one of steps S401 and S402 is NO, the purge execution flag XPGR is reset to 0 at step S406, and the purge rate PGR is made 0 at step S407.

Figure 18:
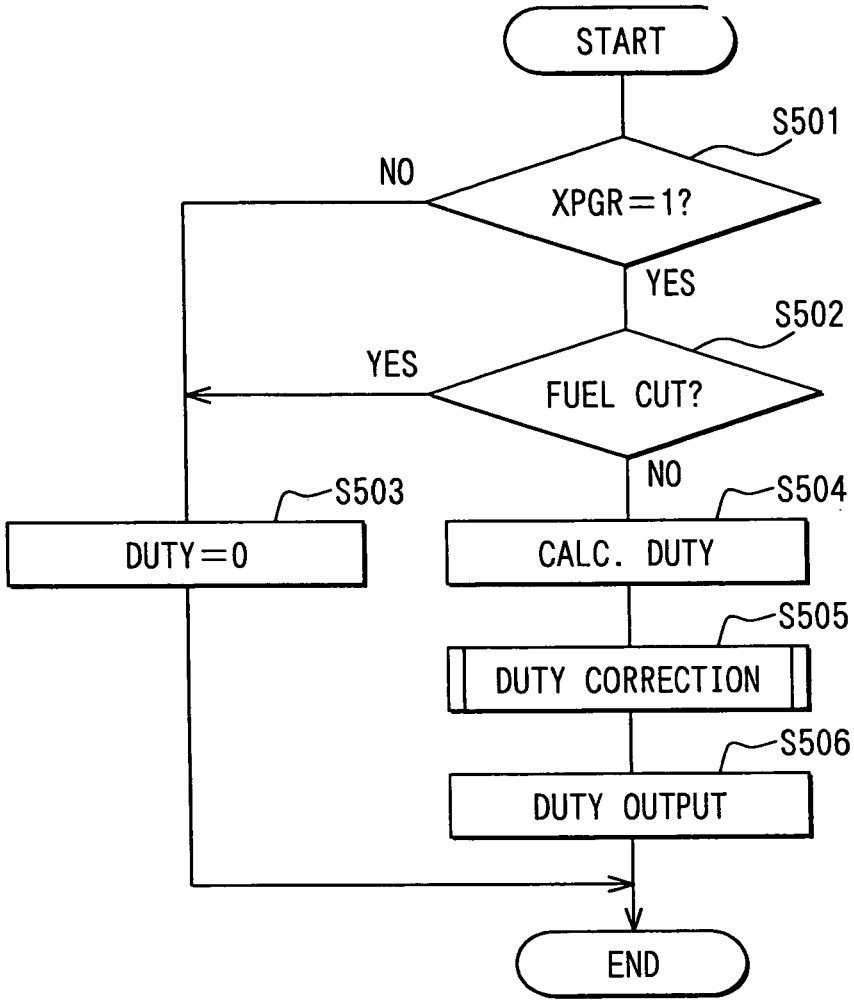
FIG. 18 is a flow chart showing a purge valve control process.

FIG. 18 is a flowchart showing a purge control valve driving processing, and this processing is performed in the engine ECU 60 by a time interrupt at, for example, every 100 ms.

In FIG. 18, first, at step S501, it is judged whether the purge execution flag XPGR is 1, and at subsequent step S502, it is judged whether fuel is being cut at present. In the case where the flag XPGR is 0 or the fuel is being cut, the procedure proceeds to step S503, and a driving duty Duty of the purge control valve 56 is made 0.

In the case where the flag XPGR is 1 and the fuel is not being cut, the procedure proceeds to step S504, and the driving duty Duty of the purge control valve 56 is calculated on the basis of the purge rate PGR in each case. At this time, the driving period of the purge control valve 56 is made 100 ms, and the driving duty Duty is calculated by the following expression.

$$\text{Duty}=(PGR/PGRfo)\times(100\text{ ms}-Pv)\times Ppa+Pv$$

In the above expression, PGRfo denotes a purge rate in each operation state at the time of full opening of the purge control valve 56, Pv denotes a voltage correction value for variation in battery voltage, and Ppa denotes an atmospheric pressure correction value for variation in atmospheric pressure.

Figure 19:
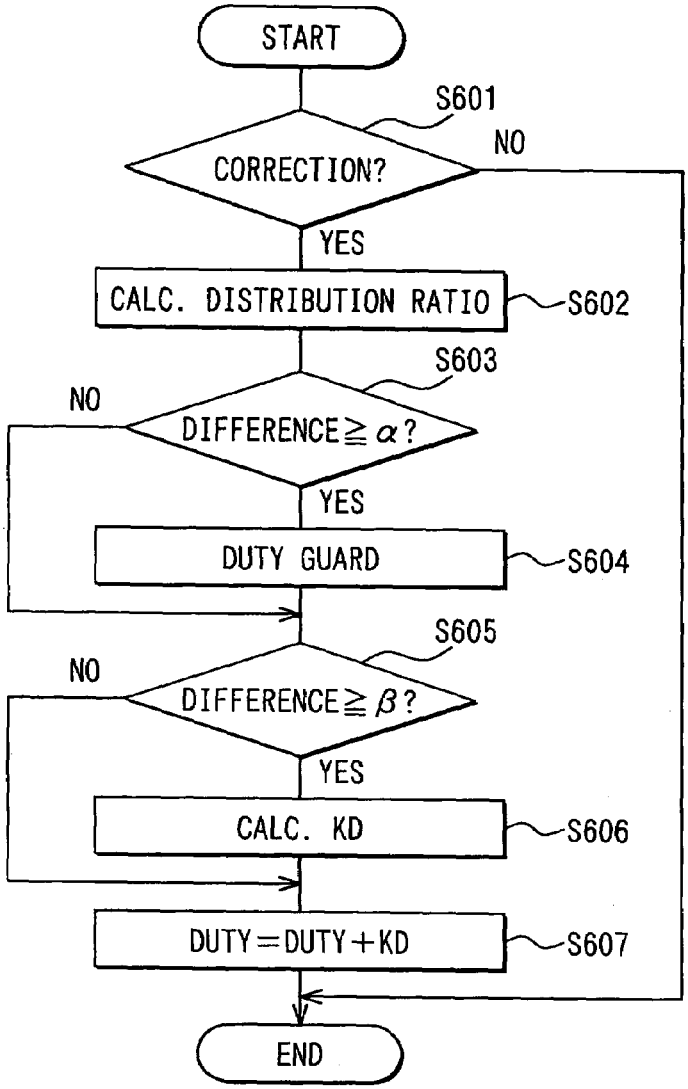
FIG. 19 is a flow chart showing a duty correction process.

Thereafter, at step S505, a Duty correction processing for correcting the driving duty Duty of the purge control valve 56 is performed. At step S506, Duty output is made, and the purge control valve 56 is driven by the pertinent Duty. FIG. 19 shows the Duty correction processing of step S505, and its content will be described below.

In FIG. 19, at step S601, it is judged whether the execution condition of the Duty correction is established. At this time, when the purge executing cylinder-by-cylinder learning value and the purge stopping cylinder-by-cylinder learning value have already been calculated in the processing of FIG. 16, and the learning has been completed, the correction condition is regarded as being established. In the case where the condition is established, the procedure proceeds to subsequent step S602, and in the case where the condition is not established, this processing is ended.

At step S602, the cylinder-by-cylinder air-fuel ratio distribution rate of the evaporated fuel released to the intake pipe 15 from the canister 53 is calculated. At this time, the distribution rate is calculated for each cylinder on the basis of the cylinder-by-cylinder correction amount of each cylinder, the purge executing cylinder-by-cylinder learning value and the purge stopping cylinder-by-cylinder learning value. Specifically, the following method is used. For example, in the first cylinder, when the cylinder-by-cylinder correction amount at each time is A1, the purge executing cylinder-by-cylinder learning value is B1, and the purge stopping cylinder-by-cylinder learning value is C1, a first cylinder correction amount deviation is calculated by the following expression:

$$\text{first cylinder correction amount deviation}=C1-(A1+B1).$$

According to the above expression, the correction amount deviation is calculated from a difference between the correction amount (C1) during the purge stop and the correction amount (A1+B1) during the purge execution. Also with respect to the second to the fourth cylinders, similarly, second to fourth cylinder correction amount deviations are calculated. A first cylinder distribution rate is calculated by the following expression:

$$\text{first cylinder distribution rate}=\text{first cylinder correction amount deviation}/\Sigma\text{ correction amount deviations of all cylinders.}$$

Also with respect to the second to the fourth cylinders, similarly, second to fourth cylinder distribution rates are calculated. In summary, as compared with the purge stop time, at the purge execution time, the correction amount is changed by the amount of fuel actually distributed to the respective cylinders, and a difference occurs (equivalent to, for example, the first cylinder correction amount deviation) as compared with the purge stopping time. Accordingly, by using the correction amount deviation of each cylinder, the cylinder-by-cylinder air-fuel ratio distribution rate can be calculated irrespective of a difference among engines, secular change and the like.

After the cylinder-by-cylinder distribution rate is calculated, at step S603, it is judged whether a difference (MAX−MIN) between a maximum and a minimum among first to fourth cylinder-by-cylinder distribution rates is a specified value $\alpha$ or higher. In the case where it is the specified value $\alpha$ or higher, the procedure proceeds to step S604, and the driving duty Duty is guarded at a specified guard value. That is, when variation in the first to the fourth cylinder-by-cylinder distribution rates is excessively large, there occurs a disadvantage that generation torque for each cylinder varies, and therefore, the Duty guard is performed (it is also possible to make Duty=0). At this time, the lower the engine load is, the more easily the torque variation occurs, and therefore, it is appropriate that the specified value a is made small in a low load area.

At step S605, it is judged whether a difference (MAX−MIN) between a maximum and a minimum among first to fourth cylinder-by-cylinder distribution rates is a specified value $\beta$ or higher ($\beta<\alpha$). In the case where the difference is $\beta$ or higher, the procedure proceeds to step S606, and a duty correction amount KD is calculated. At this time, a specified value $\Delta D$ is subtracted from the last value of the duty correction amount KD, and the result is made a current value of the duty correction amount KD (KD=last value of KD−$\Delta$D).

Finally, at step S607, the duty correction amount KD is added to the driving duty Duty calculated at step S504 of FIG. 18, so that the Duty correction is performed. At this time, for example, at step S606, when the duty correction amount KD is decreased from the former value, the driving duty Duty is decreased with respect to the former value. When the duty correction amount KD is a minus value, the driving duty Duty is corrected to decrease with respect to the basis Duty (calculation value of the step S504). In FIG. 19, the processing of step S603 and S604 can also be omitted.

At the fuel injection amount control, the purge correction according to the purge amount is performed for the basic fuel injection amount calculated based on an engine operation state and the like. However, the details are conventionally well known and will be omitted here.

According to the third embodiment, the cylinder-by-cylinder distribution rate of the purge fuel is calculated on the basis of the cylinder-by-cylinder learning value at the purge execution time/purge stop time, and in the case where the difference between the maximum value and the minimum value of the cylinder-by-cylinder distribution rates is the specified value β or higher, the driving duty Duty of the purge control valve 56 is corrected to decrease, and the fuel purge amount is decreased (including the case where the decrease correction is made with respect to the former value and the case where the decrease correction is made with respect to the base Duty). In the case where the difference between the maximum value and the minimum value of the distribution rates is the specified value a or higher, the driving duty Duty is guarded and the fuel purge amount is limited. Accordingly, it becomes possible to suppress such disadvantage that the distribution of the purge fuel between the cylinders becomes irregular, the generation torque varies due to that and the driving performance deteriorates by that. Besides, it also becomes possible to stabilize the air-fuel ratio F/B control and to improve emission.

The invention is not limited to the contents of the above embodiments, and for example, the invention may be carried out as follows.

In the air-fuel ratio F/B control, a cylinder-by-cylinder air-fuel ratio deviation (for example, a value obtained by subtracting the average value of all the cylinders from the cylinder-by-cylinder air-fuel ratio) as the cylinder-by-cylinder air-fuel ratio variation amount between cylinders is calculated on the basis of the cylinder-by-cylinder air-fuel ratio (estimated value), and a F/B gain is variably set in the air-fuel ratio F/B control according to the calculated cylinder-by-cylinder air-fuel ratio deviation. For example, in the case where the cylinder-by-cylinder air-fuel ratio deviation is the specified value or higher, the F/B gain is corrected to decrease. In summary, in the normal air-fuel ratio F/B control, optimum matching is made in the state where air-fuel ratio variation between cylinders does not exist, and there is a fear that modeling error and outer disturbance become large by variations in air-fuel ratios between the cylinders, and the stability is deteriorated. On the other hand, according to the present structure, the air-fuel ratio F/B control in view of variations in air-fuel ratios between the cylinders can be realized, and the stability of control can be secured.

Writing of the cylinder-by-cylinder learning value into the backup memory may be collectively performed at the time of main relay control at the time of ignition OFF. That is, at the time of the ignition OFF, as the main relay control, power feeding to the ECU continues for a constant time also after the OFF, and after the specified control is performed, the main relay is turned OFF by the output signal of the ECU, and the power feeding is cut off. The cylinder-by-cylinder learning value in the backup memory is updated by such main relay control.

In the above embodiment, although the fuel injection amount is controlled on the basis of the estimated value of the cylinder-by-cylinder air-fuel ratio, instead thereof, an intake air amount may be controlled. In any event, the air-fuel ratio has only to be F/B controlled with high accuracy.

As long as the multi-cylinder internal combustion engine has the structure in which exhaust passages are collected by plural cylinders, the invention can be applied to any type of engine. For example, in a 6-cylinder engine, in the case where cylinders are divided into two parts each having three cylinders and exhaust systems are constructed, an air-fuel ratio sensor is disposed at the collective part of each of the exhaust systems, and the cylinder-by-cylinder air-fuel ratio may be calculated in each of the exhaust systems as described above.

Figure 20:
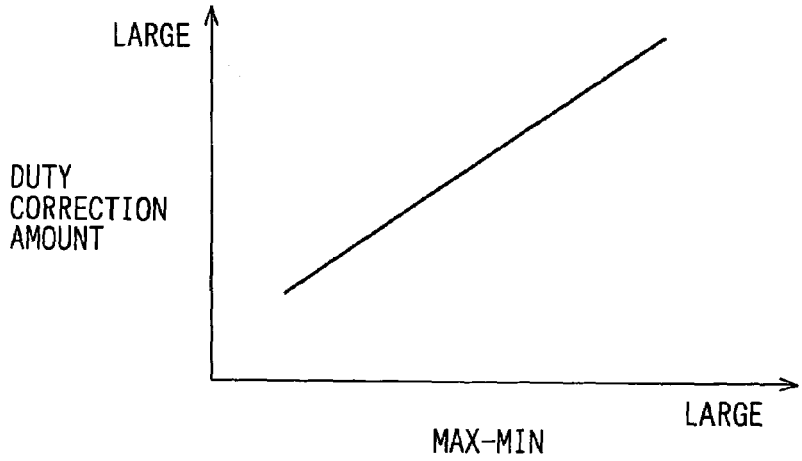
FIG. 20 is a graph showing a relation between a duty correction amount and a distribution rate.

In the third embodiment, as shown in FIG. 20, the duty correction amount is calculated to become large as the difference (MAX−MIN) between the maximum value and the minimum value of the distribution rate becomes large, the duty correction amount is subtracted from the base Duty (FIG. 18, calculation value at step S504), and the result may be made a final driving duty Duty. The difference (MAX−MIN) between the maximum value and the minimum value of the distribution rate indicates the degree of variation in distribution rate between the cylinders.

In the third embodiment, a structure is made such that the cylinder-by-cylinder learning value is not calculated, and on that basis, the cylinder-by-cylinder distribution rate may be calculated on the basis of the cylinder-by-cylinder correction amount at the purge execution time/purge stop time. In this case, "correction amount deviation=purge stopping correction amount−purge executing correction amount" is calculated for each cylinder, and the cylinder-by-cylinder distribution rate is calculated on the basis of the correction amount deviation.

In the third embodiment, although the cylinder-by-cylinder learning value at the purge execution time/purge stop time is stored in the backup memory, instead thereof or in addition thereto, the cylinder-by-cylinder distribution rate may be stored in the backup memory.

What is claimed is:

1. A cylinder-by-cylinder air-fuel ratio calculation apparatus for a multi-cylinder internal combustion engine in which the cylinder-by-cylinder air-fuel ratio calculation apparatus is applied for the multi-cylinder internal combustion engine including plural exhaust passages leading to respective cylinders and being collected, and an air-fuel ratio sensor disposed at an exhaust collective part, and calculates a cylinder-by-cylinder air-fuel ratio on the basis of a sensor detection value of the air-fuel ratio sensor, comprising:

a unit for creating a model in which the sensor detection value of the air-fuel ratio sensor is obtained by multiplying a history of a cylinder-by-cylinder air-fuel ratio of an inflow gas in the exhaust collective part and a history of the sensor detection value by specified weights respectively and by adding them, and for estimating the cylinder-by-cylinder air-fuel ratio on the basis of the model.

2. A cylinder-by-cylinder air-fuel ratio calculation apparatus for a multi-cylinder internal combustion engine according to claim 1, wherein the model is constructed by considering a first order lag element of the gas inflow and mixture in the exhaust collective part and a first order lag element of a response of the air-fuel ratio sensor.

3. A cylinder-by-cylinder air-fuel ratio calculation apparatus for a multi-cylinder internal combustion engine according to claim 1, wherein a Kalman filter type observer is used, and an estimation of the cylinder-by-cylinder air-fuel ratio is performed by the observer.

4. A cylinder-by-cylinder air-fuel ratio calculation apparatus for a multi-cylinder internal combustion engine according to claim 1, wherein the sensor detection value of the air-fuel ratio sensor is acquired at a specified reference angle position for each of the cylinders of the multi-cylinder internal combustion engine, the cylinder-by-cylinder air-fuel ratio is estimated on the basis of the acquired sensor detection value, and the reference angle position is determined while at least an operation load of the internal combustion engine is made a parameter.

5. A cylinder-by-cylinder air-fuel ratio calculation apparatus for a multi-cylinder internal combustion engine according to claim 1, wherein an estimation condition of the cylinder-by-cylinder air-fuel ratio is judged on the basis of a state of the air-fuel ratio sensor or an operation state of the internal combustion engine, and the estimation of the cylinder-by-cylinder air-fuel ratio is performed when the estimation condition is established.

6. An air-fuel ratio control apparatus for a multi-cylinder internal combustion engine, which comprises a cylinder-by-cylinder air-fuel ratio calculation apparatus according to claim 1 and performs an air-fuel ratio feedback control to make the sensor detection value of the air-fuel ratio sensor coincident with a target value, comprising:

a unit for calculating an air-fuel ratio variation amount between the cylinders on the basis of the estimated cylinder-by-cylinder air-fuel ratio; and a unit for calculating a cylinder-by-cylinder correction amount for each of the cylinders according to the calculated air-fuel ratio variation amount and for correcting an air-fuel ratio control value for each of the cylinders by the cylinder-by-cylinder correction amount.

7. An air-fuel ratio control apparatus for a multi-cylinder internal combustion engine according to claim 6, wherein an average value of the estimated cylinder-by-cylinder air-fuel ratios is calculated with respect to all the cylinders as detection objects of the air-fuel ratio sensor, the air-fuel ratio variation amount between the cylinders is calculated from differences between the average value and the cylinder-by-cylinder air-fuel ratios, and the cylinder-by-cylinder correction amount is calculated according to the air-fuel ratio variation amount.

8. An air-fuel ratio control apparatus for a multi-cylinder internal combustion engine according to claim 6, wherein an average value of the cylinder-by-cylinder correction amounts of all the cylinders is calculated, and the cylinder-by-cylinder correction amount for each of the cylinders is subtraction-corrected by the average value of all the cylinders.

9. An air-fuel ratio control apparatus for a multi-cylinder internal combustion engine according to claim 6, wherein in a case where the estimation of the cylinder-by-cylinder air-fuel ratio is allowed under a specified condition, correction of the air-fuel ratio control value by the cylinder-by-cylinder correction amount is allowed.

10. An air-fuel ratio control apparatus for a multi-cylinder internal combustion engine, which comprises a cylinder-by-cylinder air-fuel ratio calculation apparatus according to claim 1 and performs an air-fuel ratio feedback control to make the sensor detection value of the air-fuel ratio sensor coincident with a target value, comprising:

a unit for calculating an air-fuel ratio variation amount between the cylinders on the basis of the estimated cylinder-by-cylinder air-fuel ratio; and a unit for variably setting a feedback gain in the air-fuel ratio feedback control according to the calculated air-fuel ratio variation amount.

11. An air-fuel ratio control apparatus for a multi-cylinder internal combustion engine according to claim 6, further comprising:

a unit for calculating an air-fuel ratio learning value for each of the cylinders according to the cylinder-by-cylinder correction amount under a condition that the cylinder-by-cylinder air-fuel ratio control using the cylinder-by-cylinder correction amount is performed; and a unit for storing the cylinder-by-cylinder learning value in a backup memory.

12. An air-fuel ratio control apparatus for a multi-cylinder internal combustion engine according to claim 11, wherein an operation area of the internal combustion engine is divided into plural areas, and the cylinder-by-cylinder learning value is calculated for each of the divided areas and is stored in the backup memory.

13. An air-fuel ratio control apparatus for a multi-cylinder internal combustion engine according to claim 11, wherein the cylinder-by-cylinder learning value is updated only in a case where the cylinder-by-cylinder correction amount is a specified value or higher.

14. An air-fuel ratio control apparatus for a multi-cylinder internal combustion engine according to claim 13, wherein an equivalent value in a case where a difference between an average value of the estimated cylinder-by-cylinder air-fuel ratios over all the cylinders as detection objects of the air-fuel ratio sensor and the cylinder-by-cylinder air-fuel ratio is 0.01 or higher in excess air factor ($\lambda$), is made the specified value.

15. An air-fuel ratio control apparatus for a multi-cylinder internal combustion engine according to claim 13, wherein an update width of the cylinder-by-cylinder learning value per one time is determined according to the cylinder-by-cylinder correction amount in each case, and the air-fuel ratio learning value is updated by the update width.

16. An air-fuel ratio control apparatus for a multi-cylinder internal combustion engine according to claim 11, where in an update period of the air-fuel ratio learning value is made longer than a calculation period of the cylinder-by-cylinder correction amount.

17. An air-fuel ratio control apparatus for a multi-cylinder internal combustion engine according to claim 11, further comprising a unit for causing the air-fuel ratio learning value stored in the backup memory to be reflected in the cylinder-by-cylinder air-fuel ratio control at each time of fuel injection to each of the cylinders.

18. An air-fuel ratio control apparatus for a multi-cylinder internal combustion engine according to claim 17, wherein a learning execution area and a learning non-execution area are previously set in an operation area of the internal combustion engine, and in the learning non-execution area, the air-fuel ratio learning value is reflected in the cylinder-by-cylinder air-fuel ratio control by using the air-fuel ratio learning value in the learning execution area closest to the learning non-execution area.

19. An air-fuel ratio control apparatus for a multi-cylinder internal combustion engine according to claim 11, wherein in a case where an execution condition of the cylinder-by-cylinder air-fuel ratio control is not satisfied, update of the air-fuel ratio learning value is inhibited.

20. An air-fuel ratio control apparatus for a multi-cylinder internal combustion engine according to claim 11, wherein in a case where a variation amount of the sensor detection value of the air-fuel ratio sensor exceeds an allowable level, update of the air-fuel ratio learning value is inhibited.

21. An air-fuel ratio control apparatus for a multi-cylinder internal combustion engine according to claim 6, further comprising a fuel adsorption device for adsorbing an evaporated fuel, in which the fuel adsorbed by the fuel adsorption device is released to an intake system of the multi-cylinder internal combustion engine and is burned together with an injection fuel of a fuel injection device, the air-fuel ratio control apparatus further comprising:

a unit for calculating the cylinder-by-cylinder correction amount at time of execution of a fuel purge of the fuel adsorption device and at time of stop of the fuel purge; and a unit for calculating an evaporated fuel distribution rate for each of the cylinders on the basis of the respective calculated cylinder-by-cylinder correction amounts at the time of the purge execution and at the time of the purge stop.

22. An air-fuel ratio control apparatus for a multi-cylinder internal combustion engine according to claim 21, wherein the evaporated fuel distribution rate is calculated for each of the areas sorted according to an operation condition of the internal combustion engine or a fuel purge condition, and is stored in the backup memory.

23. An air-fuel ratio control apparatus for a multi-cylinder internal combustion engine according to claim 21, wherein a fuel purge amount from the fuel adsorption device to an engine intake system is controlled according to a variation degree of the evaporated fuel distribution rate between the cylinders.

24. An air-fuel ratio control apparatus for a multi-cylinder internal combustion engine according to claim 23, wherein in a case where a difference between a maximum value and a minimum value of the evaporated fuel distribution rate calculated for each of the cylinders is relatively large, the fuel purge amount is corrected to decrease.

25. An air-fuel ratio control apparatus for a multi-cylinder internal combustion engine according to claim 23, wherein in a case where a difference between a maximum value and a minimum value of the evaporated fuel distribution rate calculated for each of the cylinders is a specified value or higher, the fuel purge amount is limited.

26. An air-fuel ratio control apparatus for a multi-cylinder internal combustion engine according to claim 21, further comprising a unit for calculating a purge execution time cylinder-by-cylinder learning value on the basis of the cylinder-by-cylinder correction amount at the time of the purge execution of the fuel adsorption device, and for calculating a purge stop time cylinder-by-cylinder learning value on the basis of the cylinder-by-cylinder correction amount at the time of the purge stop, wherein the evaporated fuel distribution rate is calculated using the respective learning values.

27. An air-fuel ratio control apparatus for a multi-cylinder internal combustion engine according to claim 26, wherein cylinder-by-cylinder learning values at the purge execution time and at the purge stop time are respectively calculated for each of the areas sorted according to the operation condition of the internal combustion engine or the fuel purge condition, and are stored in the backup memory.

28. A method of calculating a cylinder-by-cylinder air-fuel ratio for a multi-cylinder internal combustion engine including plural exhaust passages leading to respective cylinders and being collected, and an air-fuel ratio sensor disposed at an exhaust collective part, the method of calculating a cylinder-by-cylinder air-fuel ratio being performed on the basis of a sensor detection value of the air-fuel ratio sensor and comprising:

creating a model in which the sensor detection value of the air-fuel ratio sensor is obtained by multiplying a history of a cylinder-by-cylinder air-fuel ratio of an inflow gas in the exhaust collective part and a history of the sensor detection value by specified weights respectively and by adding them; and estimating the cylinder-by-cylinder, air-fuel ratio on the basis of the model.

29. A cylinder-by-cylinder air-fuel ratio calculation apparatus for a multi-cylinder internal combustion engine in which the cylinder-by-cylinder air-fuel ratio calculation apparatus is applied for the multi-cylinder internal combustion engine including plural exhaust passages leading to respective cylinders and being collected, and an air-fuel ratio sensor disposed at an exhaust collective part, and calculates a cylinder-by-cylinder air-fuel ratio on the basis of a sensor detection value of the air-fuel ratio sensor, comprising:

a unit for creating an auto regressive model in which the sensor detection value of the air-fuel ratio sensor is predicted from past values by multiplying a history of a cylinder-by-cylinder air-fuel ratio of an inflow gas in the exhaust collective part and a history of the sensor detection value by specified weights respectively and by adding them, and for estimating the cylinder-by-cylinder air-fuel ratio on the basis of the model.

* * * * *